US007402741B2

(12) United States Patent
Funaki et al.

(10) Patent No.: US 7,402,741 B2
(45) Date of Patent: Jul. 22, 2008

(54) KEYBOARD APPARATUS

(75) Inventors: Tomoyuki Funaki, Hamamatsu (JP); Junichi Mishima, Iwata (JP)

(73) Assignee: Yamaha Corporation, Hamamtsu-Shi (JP)

( * ) Notice: Subject to any disclaimer, the term of this patent is extended or adjusted under 35 U.S.C. 154(b) by 197 days.

(21) Appl. No.: 11/237,380

(22) Filed: Sep. 27, 2005

(65) Prior Publication Data

US 2006/0070515 A1 Apr. 6, 2006

(30) Foreign Application Priority Data

Sep. 28, 2004 (JP) ..... 2004-282165
Sep. 26, 2005 (JP) ..... 2005-278318

(51) Int. Cl.
*G10C 3/12* (2006.01)

(52) U.S. Cl. ..... 84/423 R; 84/433; 84/434; 84/436; 84/439; 84/440

(58) Field of Classification Search ..... None
See application file for complete search history.

(56) References Cited

U.S. PATENT DOCUMENTS 4,476,769 A * 10/1984 Kumano ..... 84/434
4,512,234 A * 4/1985 Kumano ..... 84/433
4,602,549 A * 7/1986 Kumano ..... 84/433
4,604,937 A * 8/1986 Kumano et al. ..... 84/435
RE35,161 E * 2/1996 Kumano et al. ..... 84/434
5,834,668 A * 11/1998 Kumano et al. ..... 84/423 R
5,895,875 A * 4/1999 Osuga et al. ..... 84/423 R
6,005,178 A * 12/1999 Osuga et al. ..... 84/440
7,217,877 B2 * 5/2007 Funaki ..... 84/433

FOREIGN PATENT DOCUMENTS

JP S59-39740 11/1984

* cited by examiner

*Primary Examiner*—Marlon T Fletcher
(74) *Attorney, Agent, or Firm*—Morrison & Foerster LLP

(57) ABSTRACT

A keyboard apparatus which is capable of imparting a natural key depression feeling with a definite and positive load change, with a simplified construction. A key touch feeling-imparting mechanism imparts a predetermined key touch feeling to a key when it is depressed. The key touch feeling-imparting mechanism is comprised of a receiving part provided on a support member, and an elastic engaging unit that has one end thereof held by a key operating part of an associated key and another end thereof slidably engaged with the receiving part. The elastic engaging unit is disposed such that the elastic engaging unit is bent during a forward stroke of key depression caused by a key depressing operation to give a reaction force to the associated key, and the elastic engaging unit suddenly decreases in an amount of bend thereof due to a change in a sliding frictional state between the other end thereof and the receiving part during the forward stroke of key depression, to thereby decrease the reaction force given to the associated key.

22 Claims, 6 Drawing Sheets

θ
θ'
P
51
51b,50b
50
40a
40
52
52a,50a
P0
P1
P2

KEYBOARD APPARATUS

BACKGROUND OF THE INVENTION

1. Field of the Invention

The present invention relates to a keyboard apparatus that can impart a key depression feeling characteristic to a key when the key is depressed.

2. Description of the Related Art

Conventionally, an electronic piano artificially realizes a key depression feeling or a key touch feeling, such as that of an acoustic piano. However, for a keyboard apparatus, such as a portable keyboard, that is desired to be small in size, low in price, and light in weight, it is not easy to provide a mechanism (key touch feeling-imparting mechanism) that realizes the key touch feeling mentioned above, and even when the mechanism can be provided, it is desired to be as simple as possible.

To meet the requirement, Japanese Utility Model Publication (Kokoku) No. S59-39740 has proposed a keyboard apparatus in which a leaf spring having an end thereof bent into the shape of "L" is attached to an instrument body, and which is configured such that an operating element (key) is engaged with the leaf spring at an initial stage of key depression, and is disengaged as the key depression proceeds, whereby the bending of the leaf spring and the disengagement of the bent leaf spring produce a predetermined key depression feeling, with a simplified construction.

However, in the keyboard apparatus disclosed in Japanese Utility Model Publication (Kokoku) No. S59-39740, the reaction force from the depressed key is increased mainly by the bending of the leaf spring located forward of the key except for the reaction force from a key return spring provided at the rear end of the key, and hence the keyboard apparatus leaves room for improvement in obtaining a more definite change in the reaction force from the depressed key (load change). Further, a sudden decrease in the reaction force is produced by only through disengagement of the key from the leaf spring located forward of the key, and hence irrespective of a manner of key depression, such as strong depression or weak depression, a click feeling corresponding to "let-off" is produced always substantially at the same position in the forward stroke of key depression, and hence there remains room for improvement in obtaining a more natural key depression feeling as obtained from the acoustic piano.

When the key touch feeling-imparting mechanism that imparts a predetermined key touch feeling to each key is constructed individually for each key, the key depression feeling tends to vary from one key to another, and hence it is desired that the variations in the key depression feeling should be taken into account in realizing a key touch feeling. Further, it is desired that the key touch feeling-imparting mechanism should be disposed so as not to interfere with essential key function-realizing components, and so as to save space.

SUMMARY OF THE INVENTION

It is a first object of the present invention to provide a keyboard apparatus which is capable of imparting a natural key depression feeling with a definite and positive load change, with a simplified construction.

It is a second object of the present invention to provide a keyboard apparatus which is capable of imparting a key depression feeling with reduced variations between a plurality of keys, with a simplified construction.

To attain the first object, in a first aspect of the present invention, there is provided a keyboard apparatus comprising a support member, a plurality of pivots that are provided on the support member, a plurality of keys that are each pivotally supported on the support member for pivotal movement about an associated one of the pivots, the plurality of keys each having a key operating part, a key return device that imparts a returning habit to each of the keys such that the key returns into a non-depressed state when the key is not depressed, and a key touch feeling-imparting mechanism that imparts a predetermined feeling characteristic to each of the keys when the key is depressed, wherein the key touch feeling-imparting mechanism comprises a receiving part that is provided on the support member, and an elastic engaging unit that has one end thereof held by the key operating part of an associated one of the keys and another end thereof slidably engaged with the receiving part, and wherein the elastic engaging unit is disposed such that the elastic engaging unit is bent during a forward stroke of key depression caused by a key depressing operation to give a reaction force to the associated key, and the elastic engaging unit suddenly decreases in an amount of bend thereof due to a change in a sliding frictional state between the other end thereof and the receiving part during the forward stroke of key depression, to thereby decrease the reaction force given to the associated key.

With the arrangement of the first aspect of the present invention, in the forward stroke of key depression, an increase in the reaction force caused by bending of the elastic engaging unit and a sudden decrease in the reaction force caused by a sudden decrease in the amount of bend of the elastic engaging unit can give a definite and positive load change. Further, the sudden decrease in the amount of bend is caused by a change in the sliding frictional state between the other end of the elastic engaging unit and the receiving part. Therefore, if the keyboard apparatus is configured such that the manner of change in the sliding frictional state between the other end of the elastic engaging unit and the receiving part varies depending on the intensity of key depression, it is possible to obtain a natural key depression feeling dependent on the manner of key depression. Further, the key touch feeling-imparting mechanism comprises the elastic engaging unit and the receiving part, which makes it unnecessary to employ a heavy arm, and simplifies the construction of the keyboard apparatus. As a result, it is possible to impart a natural key depression feeling with a definite and positive load change with such a simplified construction. Further, since it is not necessary to use a heavy arm, it is possible to reduce the weight of the keyboard apparatus and make the same compact in size.

Preferably, the elastic engaging unit is disposed such that the elastic engaging unit is bent when the other end thereof and the receiving part are in a static frictional state, and the elastic engaging unit suddenly decreases in an amount of bend thereof as the sliding frictional state between the other end thereof and the receiving part is changed from the static frictional state into a dynamic frictional state.

Further, according to the first aspect of the present invention, it is possible to obtain an excellent static let-off feeling during weak key depression, and a lighter key depression feeling during strong key depression than during weak key depression. Further, when the disengagement occurs, the reaction force applied to the key decreases to reduce load on the key at the end of key depression, which makes the finer less liable to be fatigued.

Preferably, the elastic engaging unit is disposed such that the elastic engaging unit is bent in one direction when the associated key is in the non-depressed state, and the elastic engaging unit is further deeply bent in the one direction when the key is depressed.

Furthermore, according to the first aspect of the present invention, the elastic engaging unit can be always bent in one direction, whereby the elastic engaging unit can stably operate.

Preferably, the elastic engaging unit comprises a spring member, and the spring member stores elastic energy when the receiving part and the other end of the elastic engaging unit are frictionally engaged with each other, and releases the stored elastic energy when a frictional state between the other end of the elastic engaging unit and the receiving part has changed during the forward stroke of key depression.

With the arrangement of the preferred embodiment, by controlling the manner of change in the sliding frictional state between the other end of the elastic engaging unit and the receiving part, it is possible to control timing in which the elastic energy is released and hence obtain a natural key depression feeling dependent on the manner of key depression.

To attain the first object, in a second aspect of the present invention, there is provided a keyboard apparatus comprising a support member, a plurality of pivots that are provided on the support member, a plurality of keys that are each pivotally supported on the support member for pivotal movement about an associated one of the pivots, the keys comprising a plurality of white keys and a plurality of black keys, the keys each having a key operating part, a key return device that imparts a returning habit to each of the keys such that the key returns into a non-depressed state when the key is not depressed, a key touch feeling-imparting mechanism that imparts a predetermined feeling characteristic to each of the keys when the key is depressed, and a mass member provided in association with each of the keys, for movement in response to an operation of an associated one of the keys, wherein the key touch feeling-imparting mechanism comprises a receiving part that is provided on the support member, and an elastic engaging unit that has one end thereof held by the key operating part of an associated one of the keys and another end thereof slidably engaged with the receiving part, wherein the elastic engaging unit is disposed such that the elastic engaging unit is bent during a forward stroke of key depression caused by a key depressing operation to give a reaction force to the associated key, and the elastic engaging unit suddenly decreases in an amount of bend thereof due to a change in a sliding frictional state between the other end thereof and the receiving part during the forward stroke of key depression, to thereby decrease the reaction force given to the associated key, and wherein each of the keys, the mass member, and the key touch feeling-imparting mechanism are arranged such that a key touch feeling caused by the reaction force and inertia of the mass member is transmitted to an operator's finger via the key associated with the mass member, when the key is depressed.

With the arrangement of the second aspect of the present invention, it is possible to impart a natural key depression feeling with a definite and positive load change, with a simplified construction. Further, a depression feeling is transmitted to the finger by inertia of the mass member in addition to the reaction force of the reaction force-creating mechanism, and hence the inertia of the mass member further contributes to imparting of the depression feeling. As a result, it is possible to obtain a resistance-offering key depression feeling according to the key depression, which makes the dynamic key depression feeling closer to that felt from an acoustic piano.

To attain the first object, in a third aspect of the present invention, there is provided a keyboard apparatus comprising a support member, a plurality of keys that are pivotally supported on the support member, the keys comprising a plurality of white keys and a plurality of black keys, the keys each having a free end, and a key operating part, a key return device that imparts a returning habit to each of the keys such that the key returns into a non-depressed state when the key is not depressed, a key stopper that is provided in association with the free end of each of the keys, for abutment with an associated one of the keys to set a key depression-terminated position of key depression of the key, a key touch feeling-imparting mechanism that imparts a predetermined feeling characteristic to each of the keys when the key is depressed, a plurality of key operation-detecting sensors that are provided in association with respective ones of the keys, each of the key operation-detecting sensors being driven by an associated one of the keys to detect an operation of the key, and a sensor holding member that is held on the support member and holds the key operation-detecting sensors, wherein the key touch feeling-imparting mechanism comprises a receiving part that is provided on the support member, and an elastic engaging unit that has one end thereof held by the key operating part of an associated one of the keys and another end thereof slidably engaged with the receiving part, and the key touch feeling-imparting mechanism is disposed between the key stopper and the sensor holding member in a longitudinal direction of the associated one of the keys.

With the arrangement of the third aspect of the present invention, it is possible to impart a natural key depression feeling with a definite and positive load change, with a simplified construction. Further, the key depression feeling-imparting mechanism is disposed between the key stopper and the sensor-holding member in a direction along the length of the key. Thus, the key depression feeling-imparting mechanism can be disposed so as to make effective use of space while avoiding interference with essential key function parts, such as upper and lower limit stoppers, and a key pivot, whereby the keyboard apparatus can be made compact in size.

To attain the first object, in a fourth aspect of the present invention, there is provided a keyboard apparatus comprising a support member, a plurality of pivots that are provided on the support member, a plurality of keys that are each pivotally supported on the support member for pivotal movement about an associated one of the pivots, the keys comprising a plurality of white keys and a plurality of black keys, the keys each having a key operating part, a key return device that imparts a returning habit to each of the keys such that the key returns into a non-depressed state when the key is not depressed, and a key touch feeling-imparting mechanism that imparts a predetermined feeling characteristic to each of the keys when the key is depressed, wherein the key touch feeling-imparting mechanism comprises a receiving member that is provided on the support member, and a reaction force-imparting member that is disposed in association with each of the keys, for cooperating with the receiving member to impart a reaction force to an associated one of the keys when the key is depressed, and wherein the receiving member is formed in one body having a white key-receiving part provided for an associated one of the white keys and a black key-receiving part provided for an associated one of the black keys, and the white key-receiving part and the black key-receiving part are juxtaposed, below the key operating part of the associated one of the white keys and the key operating part of the associated one of the black keys in a direction of juxtaposition of the keys.

With the arrangement of the fourth aspect of the present invention, the white key-receiving part and the black key-receiving part are shared by a plurality of white keys and a plurality of black keys, respectively, which simplifies the construction of the keyboard apparatus, and due to integration of the receiving parts, variations in key depression feeling between the keys can be suppressed. As a result, it is possible to impart a key depression feeling with reduced variations between the keys, with a simplified construction.

To attain the first object, in a fifth aspect of the present invention, there is provided a keyboard apparatus comprising a support member, a plurality of pivots that are provided on the support member, a plurality of keys that are each pivotally supported on the support member for pivotal movement about an associated one of the pivots, a key return device that imparts a returning habit to each of the keys such that the key returns into a non-depressed state when the key is not depressed, and a key touch feeling-imparting mechanism that imparts a predetermined feeling characteristic to each of the keys when the key is depressed, wherein each of the keys has a key operating part, wherein the key touch feeling-imparting mechanism comprises a receiving part that is provided on the support member, and an elastic engaging unit that has one end thereof held by the key operating part of an associated one of the keys, wherein the elastic engaging unit comprises a member that is capable of storing elastic energy, and a frictional member that is slidably engaged with the receiving part disposed at another end of the elastic engaging unit, and wherein the elastic engaging unit is disposed such that the elastic engaging unit stores elastic energy when the receiving part and the frictional member are frictionally engaged with each other, and releases the stored elastic energy due to a change in a frictional state between the frictional member and the receiving part during a forward stroke of key depression.

With the arrangement of the fifth aspect of the present invention, during the forward stroke of key depression, it is possible to give a definite and positive load change by storage of elastic energy and subsequent release of the stored elastic energy. Further, the release of the elastic energy is caused by a change in the sliding frictional state between the frictional member of the elastic engaging unit and the receiving part, and hence, by configuring the keyboard apparatus such that the manner of change in the sliding frictional state between the frictional member and the receiving part depends on the intensity of key depression, it is possible to obtain a natural key depression feeling dependent on the manner of key depression, specifically, a let-off feeling like that obtained by an acoustic piano can be obtained.

Preferably, the elastic engaging unit releases the stored elastic energy when the elastic member starts to slide on the receiving part.

With the arrangement of the preferred embodiment, it is possible to give a natural key depression feeling with a define and positive load change. Particularly, the stored elastic energy is released simultaneously when the frictional member starts to slide on the receiving part, which makes it possible to obtain a more natural let-off feeling.

More preferably, the elastic engaging unit changes a degree of release of the stored elastic energy according to a manner of key depression.

With the arrangement of the preferred embodiment, it is possible to obtain a static let-off feeling during the weak key depression, and obtain a dynamic let-off feeling during the strong key depression.

To attain the first object, in a sixth aspect of the present invention, there is provided a keyboard apparatus comprising a support member, a plurality of pivots that are provided on the support member, a plurality of keys that are each pivotally supported on the support member for pivotal movement about an associated one of the pivots, a key return device that imparts a returning habit to each of the keys such that the key returns into a non-depressed state when the key is not depressed, and a key touch feeling-imparting mechanism that imparts a predetermined feeling characteristic to each of the keys when the key is depressed, wherein each of the keys has a key operating part, wherein the key touch feeling-imparting mechanism comprises a receiving part that is provided on the support member, and an elastic engaging unit that has one end thereof held by the key operating part of an associated one of the keys, wherein the receiving part slopes with respect to the key depression direction, wherein the elastic engaging unit comprises a member that is capable of storing elastic energy, and a frictional member that is slidably engaged with the receiving part disposed at another end of the elastic engaging unit, and wherein the receiving part and the elastic engaging unit are disposed such that an angle formed between a line segment connecting between a contact point of the receiving part and the frictional member and the one end of the elastic engaging unit, and the receiving part progressively decreases as a forward stroke of key depression proceeds.

With the arrangement of the sixth aspect of the present invention, during the forward stroke of key depression, it is possible to give a smooth load change by a progressive decrease in the angle formed between the line segment connecting between the contact point of the receiving part and the frictional member and the one end of the elastic engaging unit, and the receiving part. Particularly, the above angle decreases at a late stage of the forward stroke of key depression, which makes it possible to obtain a smooth let-off feeling.

Preferably, the receiving part and the elastic engaging unit are disposed such that the frictional member starts to slide on the receiving part during the forward stroke of key depression, and until the frictional member starts to slide on the receiving part, the angle does not progressively decrease so as to assist storage of elastic energy in the elastic engaging unit, and after the frictional member starts to slide on the receiving part, the angle progressively decreases as the forward stroke of key depression proceeds.

With the arrangement of this preferred embodiment, the stored elastic energy is released during the forward stroke of key depression, and thereafter, the angle progressively decreases, which makes it possible to obtain a static let-off feeling in particular.

To attain the first object, in a seventh aspect of the present invention, there is provided a keyboard apparatus comprising a support member, a plurality of pivots that are provided on the support member, a plurality of keys that are each pivotally supported on the support member for pivotal movement about an associated one of the pivots, a key return device that imparts a returning habit to each of the keys such that the key returns into a non-depressed state when the key is not depressed, and a key touch feeling-imparting mechanism that imparts a predetermined feeling characteristic to each of the keys when the key is depressed, wherein each of the keys has a key operating part, wherein the key touch feeling-imparting mechanism comprises an elastic engaging unit that has one end thereof held by the key operating part of an associated one of the keys and another end thereof holding a mass member, and a receiving part that is provided on the support member, wherein the receiving part slopes with respect to the key depression direction, wherein the other end of the elastic engaging unit is slidably engaged with the receiving part, wherein the elastic engaging unit comprises a member that is capable of storing elastic energy, and wherein the receiving part and the elastic engaging unit are disposed such that an angle formed between a line segment connecting between a contact point of the receiving part and the other end of the elastic engaging unit and the one end of the elastic engaging unit, and the receiving part progressively decreases as a forward stroke of key depression proceeds.

With the arrangement of the seventh aspect of the present invention, during the forward stroke of key depression, a definite and positive load change can be given by storage of static energy and subsequent release of the stored elastic energy. Further, the release of the elastic energy is caused by a change in the sliding frictional state between the other end of the elastic engaging unit and the receiving part, but the manner of change in the sliding frictional state varies depending the inertial force of the mass member. Further, the inertial force of the mass member depends varies depending on the intensity of key depression. Furthermore, during the forward stroke of key depression, a progressive decrease in the angle formed between the line segment connecting between the contact point of the receiving part and the other end of the elastic engaging unit and the one end of the elastic engaging unit and the receiving part makes it possible to give a smooth load change. Therefore, it is possible to obtain an excellent let-off feeling dependent on the manner of key depression.

Preferably, the receiving part and the elastic engaging unit are disposed such that the other end of the elastic engaging unit starts to slide on the receiving part during the forward stroke of key depression, and until the other end of the elastic engaging unit starts to slide on the receiving part, the angle does not progressively decrease so as to assist storage of elastic energy in the elastic engaging unit, and after the other end of the elastic engaging unit starts to slide on the receiving part, the angle progressively decreases as the forward stroke of key depression proceeds.

With the arrangement of the preferred embodiment, during the forward stroke of key depression, the stored elastic energy is released, and thereafter, the angle progressively decreases, which makes it possible to obtain a static let-off feeling in particular.

To attain the first object, in an eighth aspect of the present invention, there is provided a keyboard apparatus comprising a support member, a plurality of pivots that are provided on the support member, a plurality of keys that are each pivotally supported on the support member for pivotal movement about an associated one of the pivots, a key return device that imparts a returning habit to each of the keys such that the key returns into a non-depressed state when the key is not depressed, and a key touch feeling-imparting mechanism that imparts a predetermined feeling characteristic to each of the keys when the key is depressed, wherein each of the keys has a key operating part, wherein the key touch feeling-imparting mechanism comprises a receiving part that is provided on the support part, and an elastic engaging unit that has one end thereof held by the key operating part of an associated one of the keys and another end thereof in contact with the receiving part, wherein the elastic engaging unit comprises a member that is capable of storing elastic energy, wherein the elastic engaging unit is disposed to starts sliding on the receiving part during a forward stroke of key depression, and wherein the receiving part and the elastic engaging unit are disposed such that a contact angle formed between the receiving part and the other end of the elastic engaging unit progressively decreases as the forward stroke of key depression proceeds.

With the arrangement of the eighth aspect of the present invention, during the forward stroke of key depression, a smooth load change can be given due to a progressive decrease in the contact angle between the receiving part and the other end. Particularly, the angle suddenly decreases at a late stage of the forward stroke of key depression, which makes it possible to obtain a smooth let-off feeling.

Preferably, the elastic engaging unit comprises a spring member, and the spring member is disposed such that the contact angle progressively decreases as an amount of bend of the spring member in a predetermined direction progressively increases, wherein the spring member is bent beforehand in the predetermined direction at a start of the forward stroke of key depression.

With the arrangement of the preferred embodiment, the spring member is bent beforehand in the predetermined direction at the start of the forward stroke of key depression, and hence, when the contact angle between the receiving part and the contact member progressively decreases, most of the elastic energy stored in the spring member can be released in a direction in which the key does not receive the reaction force, whereby a further smooth let-off feeling can be obtained.

To attain the first object, in a ninth aspect of the present invention, there is provided a keyboard apparatus comprising a support member, a plurality of pivots that are provided on the support member, a plurality of keys that are each pivotally supported on the support member for pivotal movement about an associated one of the pivots, a key return device that imparts a returning habit to each of the keys such that the key returns into a non-depressed state when the key is not depressed, and a key touch feeling-imparting mechanism that imparts a predetermined feeling characteristic to each of the keys when the key is depressed, wherein each of the keys has a key operating part, wherein the key touch feeling-imparting mechanism comprises an elastic engaging unit that has one end thereof held by the key operating part of an associated one of the keys and another end thereof holding a mass member, and a receiving part that is provided on the support member, wherein the other end of the elastic engaging unit is slidably engaged with the receiving part, wherein the elastic engaging unit comprises a member that is capable of storing elastic energy, wherein the elastic engaging unit is disposed such that the other end thereof starts to slide on the receiving part during a forward stroke of key depression, and wherein the receiving part and the elastic engaging unit are disposed such that a contact angle formed between the receiving part and the other end of the elastic engaging unit progressively decreases as the forward stroke of key depression proceeds.

With the arrangement of the ninth aspect of the present invention, during the forward stroke of key depression, a definite and positive load change can be given by storage of elastic energy and subsequent release of the stored elastic energy. Further, the release of the elastic energy is caused by a change in the sliding frictional state between the other end of the elastic engaging unit and the receiving part, but the manner of change in the sliding frictional state varies depending on the inertial force of the mass member. Further, the inertial force of the mass member depends on the intensity of key depression. Furthermore, during the forward stroke of key depression, it is possible to give a smooth load change by a progressive decrease in the contact angle between the receiving part and the other end of the elastic engaging unit, whereby an excellent let-off feeling dependent on the manner of key depression can be obtained.

Preferably, the elastic engaging unit comprises a spring member, and the spring member is disposed such that the contact angle progressively decreases as an amount of bend of the spring member in a predetermined direction progressively increases, wherein the spring member is bent beforehand in the predetermined direction at a start of the forward stroke of key depression.

With the arrangement of the preferred embodiment, the spring member is bent beforehand in the predetermined direction at the start of the forward stroke of key depression, and hence most of the elastic energy stored in the spring member can be released in a direction in which the key does not receive the reaction force, when the contact angle between the receiving part and the other end of the elastic engaging unit progressively decreases, whereby a further smooth let-off feeling can be obtained.

To attain the first object, in a tenth aspect of the present invention, there is provided a keyboard apparatus comprising a support member, a plurality of pivots that are provided on the support member, a plurality of keys that are each pivotally supported on the support member for pivotal movement about an associated one of the pivots, a key return device that imparts a returning habit to each of the keys such that the key returns into a non-depressed state when the key is not depressed, and a key touch feeling-imparting mechanism that imparts a predetermined feeling characteristic to each of the keys when the key is depressed, wherein each of the keys has a key operating part, wherein the key touch feeling-imparting mechanism comprises a engaging unit connected to the key operating part of an associated one of the keys, and a receiving part that is provided on the support member, wherein the receiving part slopes with respect to the key depression direction, wherein the engaging unit has one end thereof rotatably connected to the key operating part, and another end thereof slidably engaged with the receiving part and holding a mass member, and wherein the receiving part and the engaging unit are disposed such that an angle formed between a line segment connecting between a contact point of the receiving part and the other end of the engaging unit and the one end of the engaging unit, and the receiving part progressively decreases as a forward stroke of key depression proceeds.

With the arrangement of the tenth aspect of the present invention, even when a key is depressed, neither buckling nor bending of the engaging unit occurs, but pivotal motion of the engaging unit causes the other end of the engaging unit to slide on the receiving part. The friction occurring this time produces the reaction force. Then, falling-off of the other end from the receiving part suddenly decreases the reaction force. By properly setting the friction between the other end and the receiving part, it is possible to adjust the key depression feeling. Further, since inertia is imparted to the mass member, a natural key depression feeling can be realized. Further, during the forward stroke of key depression, a smooth load change can be given by a progressive decrease in the angle formed between the line segment connecting between the contact point of the receiving part and the other end of the engaging unit and the one end of the engaging unit, and the receiving part.

To attain the first object, in an eleventh aspect of the present invention, there is provided a keyboard apparatus comprising a support member, a plurality of pivots that are provided on the support member, a plurality of keys that are each pivotally supported on the support member for pivotal movement about an associated one of the pivots, a key return device that imparts a returning habit to each of the keys such that the key returns into a non-depressed state when the key is not depressed, and a key touch feeling-imparting mechanism that imparts a predetermined feeling characteristic to each of the keys when the key is depressed, wherein each of the keys has a key operating part, wherein the key touch feeling-imparting mechanism comprises a engaging unit connected to the key operating part of an associated one of the keys, and a receiving part that is provided on the support member, wherein the engaging unit has one end thereof rotatably connected to the key operating part, and another end thereof slidably engaged with the receiving part and holding a mass member, and wherein the receiving part and the engaging unit are disposed such that a contact angle formed between the receiving part and the other end of the engaging unit progressively decreases as the forward stroke of key depression proceeds.

With the arrangement of the eleventh aspect of the present invention, even when a key is depressed, neither buckling nor bending of the engaging unit occurs, but pivotal motion of the engaging unit causes the other end of the engaging unit to slide on the receiving part. The friction occurring this time produces the reaction force. Then, falling-off of the other end from the receiving part suddenly decreases the reaction force. By properly setting the friction between the other end and the receiving part, it is possible to adjust the key depression feeling. Further, since the inertia is imparted to the mass member, a natural key depression feeling can be realized. Further, during the forward stroke of key depression, a smooth load change can be given by a progressive decrease in the contact angle between the receiving part and the engaging unit.

Preferably, the engaging unit comprises a plate spring member, and the other end of the plate spring member is bent such that the plate spring member is operable when the key is depressed, to bend in a predetermined direction.

With the arrangement of the preferred embodiment, most of the elastic energy stored in the plate spring member can be released in a direction in which the key does not receive the reaction force, when the key is depressed, whereby a further smooth let-off feeling can be obtained.

The above and other objects, features, and advantages of the present invention will become more apparent from the following detailed description taken in conjunction with the accompanying drawings.

BRIEF DESCRIPTION OF THE DRAWINGS

FIGS. 1A to 1D are longitudinal cross-sectional views of a keyboard apparatus according to a first embodiment of the present invention, in which:

FIG. 1A shows the keyboard apparatus in a non-key-depressed state (key released state);

FIGS. 1B and 1C show the keyboard apparatus in states during key depression; and FIG. 1D shows the keyboard apparatus in a key depression-terminated state;

FIGS. 3A to 3D are cross-sectional views schematically showing changes in the engagement relationship between an elastic engaging unit and a receiving part during a forward stroke of key depression, in which FIG. 3A shows the elastic engaging unit and the receiving part in a non-key-depressed state;

FIGS. 3B and 3C show the elastic engaging unit and the receiving part in states during key depression; and FIG. 3D shows the elastic engaging unit and the receiving part in the key depression-terminated state;

FIGS. 5A to 5C are views schematically showing the construction of a common base appearing in FIG. 4, in which:

FIG. 5A is a perspective view of the common base;

FIG. 5B is a fragmentary cross-sectional view showing the construction of a part of the key touch feeling-imparting mechanism associated with a single white key; and FIG. 5C is a side view of a mounting part of the part of the key touch feeling-imparting mechanism associated with the single white key via which the part is mounted on a fixing member;

FIGS. 6A and 6B are views schematically showing the construction of a key touch feeling-imparting mechanism of a keyboard apparatus according to a third embodiment of the present invention, in which;

FIG. 6A is a side view of the key touch feeling-imparting mechanism; and

FIG. 6B is a fragmentary side view of the key touch feeling-imparting mechanism according to a variation of the keyboard apparatus according to the third embodiment.

DETAILED DESCRIPTION OF THE PREFERRED EMBODIMENTS

The present invention will now be described in detail with reference to the drawings showing preferred embodiments thereof.

Figure 1A:
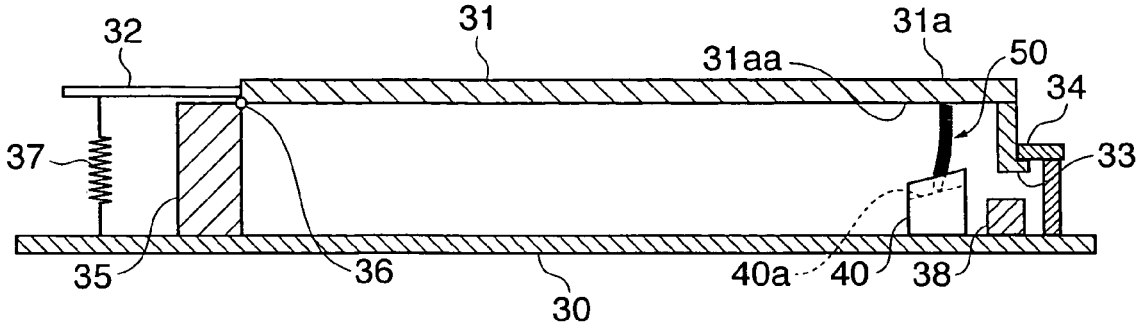
Figure 1B:
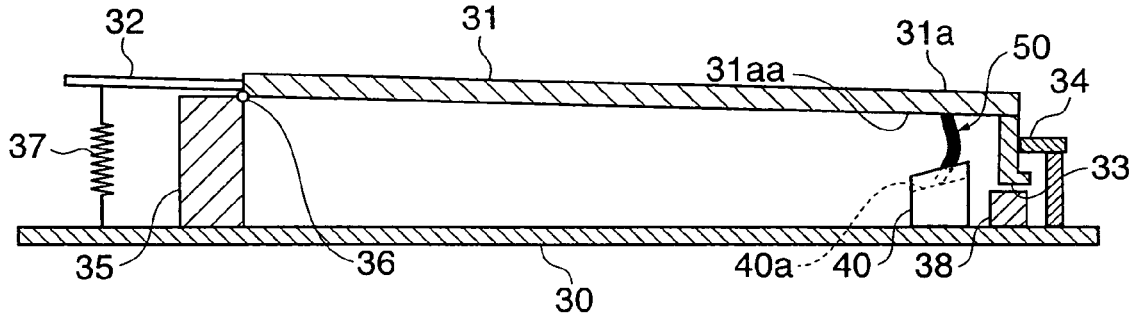
Figure 1C:
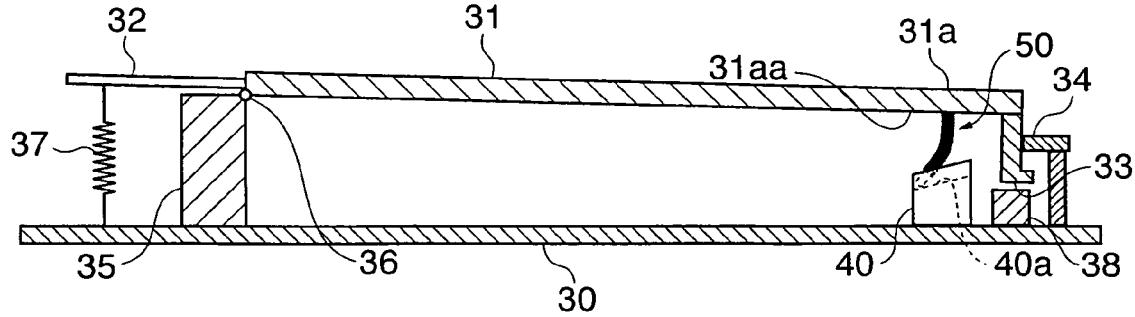
Figure 1D:
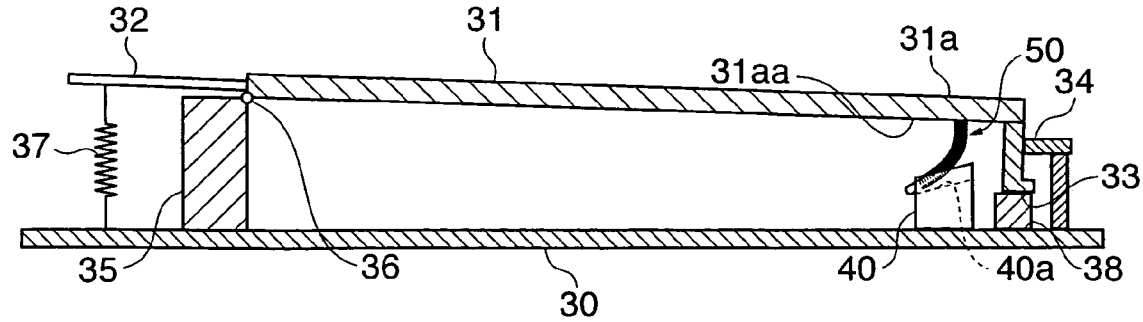

FIGS. 1A to 1D are longitudinal cross-sectional views of a keyboard apparatus according to a first embodiment of the present invention. FIG. 1A shows the keyboard apparatus in a non-key-depressed state; FIGS. 1B and 1C show the same in states during key depression; and FIG. 1D shows the same in a key depression-terminated state. As shown in FIG. 1A, a support member 30 has a support column 35 as a key support provided thereon, and a key body 31 is supported by the support column 35 for vertical swinging motion about a pivot 36 provided on the top of the support column 35. In the following description, a free end side of the key body 31 (right side as viewed in FIG. 1A) will be referred to as "the front side". In FIGS. 1A to 1D, a white key is shown as the key body 31, by way of example.

An extended part 32 extends rearward from the pivot 36 of the key body 31, and a key return spring 37 is stretched as a key return device between the extended part 32 and the support member 30, for always pulling the key body 31 in a counterclockwise direction about the pivot 36 as viewed in FIG. 1A. The key return spring 37 may be replaced by a weight member attached to a front end of the extended part 32 as a key return device. The key body 31 has a key operating part 31*a* formed at a front part thereof, with which the user operates the key body 31. A stopper abutment part 33 suspends from the underside of a front end of the key body 31.

The support member 30 has an upper limit stopper 34 and a lower limit stopper 38 secured thereto at a location thereof corresponding to the stopper abutment part 33. In a non-key-depressed state shown in FIG. 1A, the stopper abutment part 33 is brought into abutment with the upper limit stopper 34 by the pulling force of the key return spring 37, which sets a non-key-depressed position of the key body 31 (i.e. an initial position of the forward stroke of key depression). On the other hand, during key depression, when the key body 31 is fully depressed, the stopper abutment part 33 is brought into abutment with the lower limit stopper 38, which sets a terminal position of the forward stroke of key depression of the key body 31 (see FIG. 1D).

Although not shown, the support member 30 is provided with a key depression switch that is actuated by the key body 31 during key depression, whereby a key depression operation and a key release operation performed by the user on the key body 31 are detected. The key body 31 has an elastic engaging unit 50, referred to hereinafter, mounted on the underside of the front end thereof at a location somewhat rearward of the stopper abutment part 33, in a manner suspended therefrom. A receiving part 40, referred to hereinafter, is secured to the support member 30, for applying load to the key body 31 against the depression thereof, in cooperation with the elastic engaging unit 50.

Figure 2:
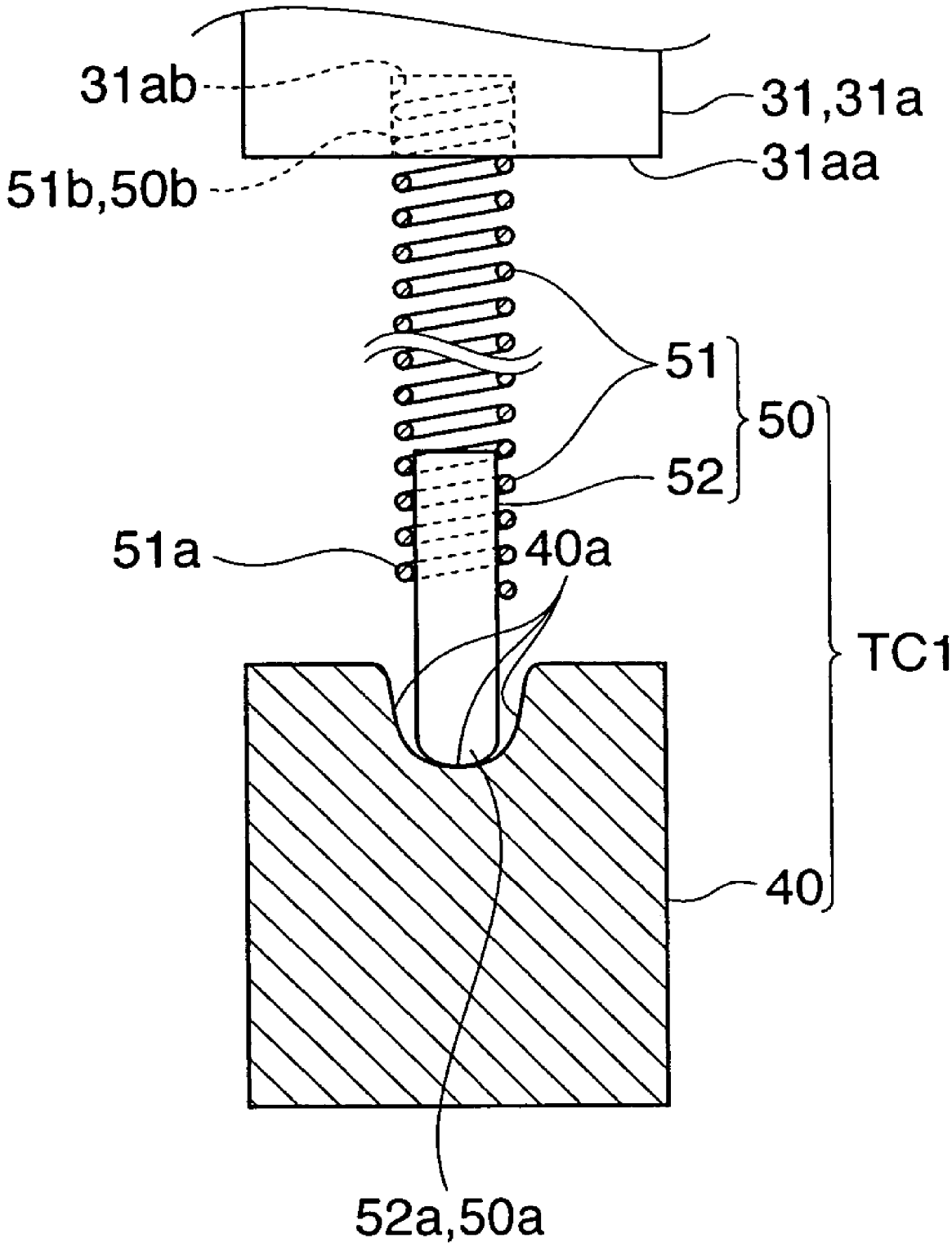
FIG. 2 is a cross-sectional view showing the construction of a key touch feeling-imparting mechanism associated with one key body.

FIG. 2 is a cross-sectional view showing the construction of a key touch feeling-imparting mechanism associated with a single key body 31. The elastic engaging unit 50 and the receiving part 40 are provided in association with each key body 31. The key body 31 is different in shape between a white key and a black key, but basically has the same construction therebetween. The elastic engaging unit 50 and the receiving part 40 are different in location between the key bodies 31 with each of which they are associated, but basically has the same constructions therebetween, respectively. The key touch feeling-imparting mechanism TC1 associated with each key body 31 is comprised of one elastic engaging unit 50 and one receiving part 40 as shown in FIG. 2. The receiving part 40 may be constructed as a common part for a plurality of key bodies 31 to be shared thereby.

Figures 3A, 3B, 3C, 3D:
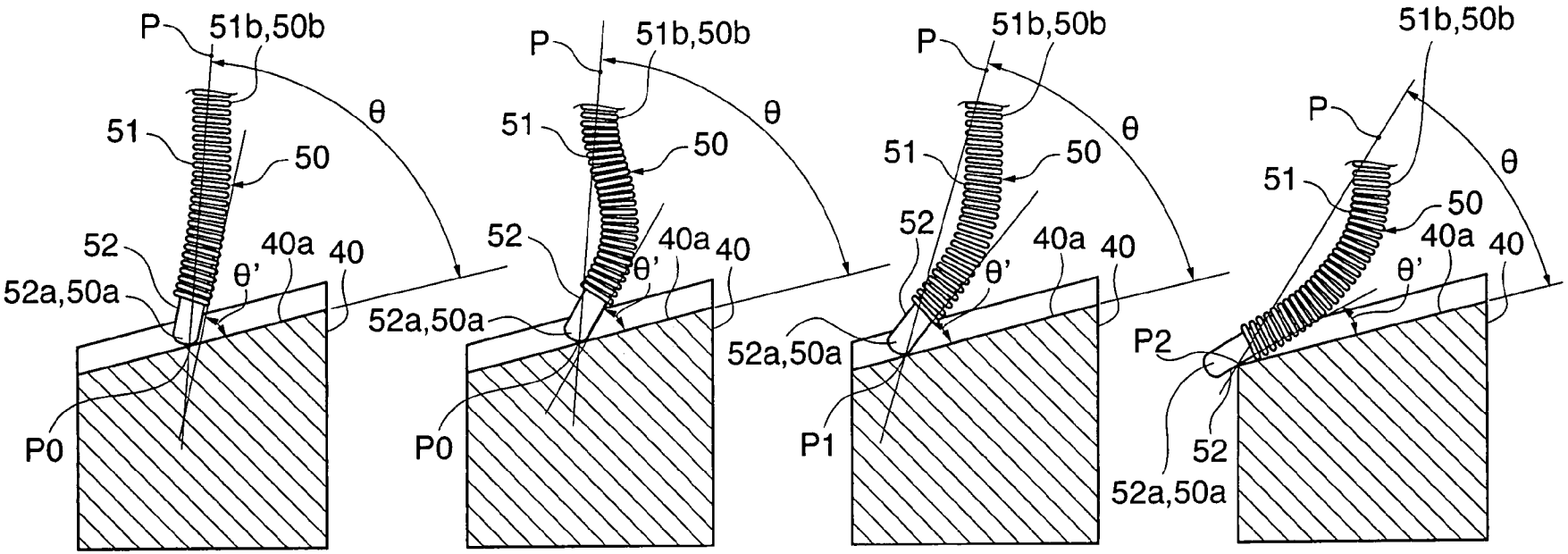

FIGS. 3A to 3D are cross-sectional views schematically showing changes in the engagement relationship between the elastic engaging unit 50 and the receiving part 40 during the forward stroke of key depression. FIG. 3A shows the elastic engaging unit 50 and the receiving part 40 in the non-key-depressed state; FIGS. 3B and 3C show the same in states during key depression; and FIG. 3D shows the same in the key depression-terminated state. FIGS. 3A to 3D correspond to FIGS. 1A to 1D, in respect of the state of key depression.

FIGS. 1A to 1D and FIGS. 3A to 3D shows changes in the operation of the key body 31 when it is slowly depressed (hereinafter referred to as the "weak key depression"), by way of example. The "weak key depression" is a key depression style corresponding to key depression intensities ranging from a very weak key depression intensity in which a hammer barely strikes the associated string to a relatively weak key depression intensity in the case of an acoustic piano. In contrast thereto, a key depression style much stronger in key depression intensity than the weak key depression and corresponding to key depression intensities ranging from a key depression intensity for normal sounding to a key depression intensity for strong sounding is referred to as the "strong key depression".

As shown in FIG. 2, the elastic engaging unit 50 is comprised of a coil spring 51 and a pin 52, and the pin 52 is press-fitted in a lower end 51*a* of the coil spring 51 and fixed thereto by an adhesive or the like. An upper end 51*b* of the coil spring 51 corresponding to an upper end 50*b* of the elastic engaging unit 50 is press-fitted into a fixing hole 31*ab* of the key operating part 31*a* of the key body 31 and fixed thereto by an adhesive or the like. The coil spring 51 extends downward from a lower end face 31*aa* of the key operating part 31*a*. The pin 52 is formed of a frictional member capable of producing an appropriate friction, such as a resin or wood.

The receiving part 40 is formed with a guide rail 40*a* as an groove-like recess extending in the longitudinal direction (substantially along the length of the key body 31). The receiving part 40 may be formed by members of a plurality of materials, but at least a part thereof defining the guide rail 40*a* is formed of a material, such as felt, which is capable or producing an appropriate friction against the pin 52.

As shown in FIG. 3A, the guide rail 40*a* of the receiving part 40 slopes downward in a rearward direction. The coil spring 51 extends substantially straight downward from the lower end face 31*aa* of the key operating part 31*a*, insofar as the a part thereof close to the upper end 51*b* is concerned, and when the key body 31 is in the non-key-depressed state, a lower end 52*a* of the pin 52, which also corresponds to the lower end 50*a* of the elastic engaging unit 50, is in abutment with the guide rail 40*a* (also see FIG. 2). This causes the coil spring 51 to be bent (curved) at a longitudinally intermediate part thereof in a manner slightly projecting toward the front side. Moreover, the lower end 52*a* of the pin 52 can slide on the guide rail 40*a* as the key depression proceeds. In the present embodiment, the coil spring 51 extends straight when left alone or in a free state, and hence if the receiving part 40 were not provided, it would exhibit a straight extending shape.

New, a description will be given of the operation of the key touch feeling-imparting mechanism constructed above during the weak key depression. When key depression is started from the non-key-depressed state shown in FIGS. 1A and 3A, the operation proceeds as shown in FIGS. 1B to 1D and FIGS. 3B to 3D. More specifically, first, in the non-key-depressed state shown in FIG. 1A, the lower end 50*a* of the elastic engaging unit 50 is in abutment with the guide rail 40*a* of the receiving part 40 at a contact point PO as shown in FIG. 3A, and in a relatively early stage of the forward stroke of key depression when the key operating part 31*a* is further depressed slightly downward, as shown in FIG. 1B, the lower end 50*a* of the elastic engaging unit 50 maintains the abutment with the guide rail 40*a* at the same contact point PO, as shown in FIG. 3B.

More specifically, the lower end 50*a* of the elastic engaging unit 50 and the guide rail 40*a* are in a state where an appropriate friction is produced therebetween, and the static frictional state between them is maintained from the state shown in FIG. 3A to the state shown in FIG. 3B. Further, when the key touch feeling-imparting mechanism is in the state shown in FIG. 3B, the position of the key operating part 31*a* is lower than when the same is in the state in FIG. 3A, and hence the elastic engaging unit 50 (specifically, the coil spring 51) is further bent such that it generally protrudes in the same direction (toward the front side) as it does beforehand. Hereafter, the increase in the amount of bend described above will be referred to as "additional bend", in the present embodiment as well as a second embodiment described hereinafter. The reaction force produced by the additional bend of the coil spring 51 acts on the key body 31, and insofar as the static frictional state between the lower end 50*a* of the elastic engaging unit 50 and the guide rail 40*a* is maintained, the reaction force against key depression increases as the depression proceeds.

Thereafter, when the key operating part 31*a* is further depressed, at a late stage of the forward stroke of key depression shown in FIG. 1C, the sliding frictional state between the lower end 50*a* of the elastic engaging unit 50 and the guide rail 40*a* changes from the static frictional state into the dynamic frictional state as shown in FIG. 3C. Therefore, the boundary between the static frictional state and the dynamic frictional state exists between FIG. 3B and FIG. 3C. When the lower end 50*a* of the elastic engaging unit 50 and the guide rail 40*a* are in the dynamic frictional state, the former slides on the latter in sliding contact therewith at a contact point P1 rearward of the contact point PO, such that the contact point P1 moves rearward. Actually, the moment that the sliding frictional state changes from the static frictional state into the dynamic frictional state, the additional bend of the coil spring 51 is instantaneously released, i.e. the amount of bend of the coil spring 51 is suddenly reduced. This suddenly decreases the reaction force applied to the key body 31 by the additional bend.

Thereafter, when the key operating part 31*a* is further depressed until the key touch feeling-imparting mechanism is in the key depression-terminated state shown in FIG. 1D, the lower end 50*a* of the elastic engaging unit 50 falls off a rear end of the guide rail 40*a*. Actually, a time period between a time point the sliding frictional state between the lower end 50*a* of the elastic engaging unit 50 and the guide rail 40*a* changes from the static frictional state into the dynamic frictional state and a time point the lower end 50*a* falls off the guide rail 40*a* is very short, i.e. the change is completed in an instant. This can provide a feeling quite similar to a static let-off feeling. Further, the reaction force acting on the key body 31 after termination of the key depression is small, so that the finger continuing to depress the key body 31 is prevented from receiving a large load therefrom, which saves the finger from being fatigued.

On the other hand, during the strong key depression, the key touch feeling-imparting mechanism operates in the following manner: In the case of the strong key depression, as is distinct from the weak key depression, the sliding frictional state between the lower end 50*a* of the elastic engaging unit 50 and the guide rail 40*a* very smoothly changes from the static frictional state into the dynamic frictional state. Since the time period of the static frictional state is short, and hence the additional bend of the coil spring 51 as shown in FIG. 3B is not caused, and hence substantially from the start of the forward stroke of key depression, the lower end 50*a* of the elastic engaging unit 50 and the guide rail 40*a* are in sliding relationship with each other. Consequently, the reaction force caused by the additional bend of the coil spring 51 is scarcely applied to the key body 31, and as shown in FIG. 3D, the lower end 50*a* of the elastic engaging unit 50 falls off the rear end of the guide rail 40*a*. Here, the key body 31 has a large mass, and hence during strong key depression, the inertial mass of the key body 31 increases to overcome or mask the reaction force from the coil spring and the frictional force between the lower end 50*a* and the guide rail 40*a*, whereby the reaction force and the frictional force are not smoothly transmitted to the player's finger. Further, when the lower end 50*a* of the elastic engaging unit 50 falls off the rear end of the guide rail 40*a*, the player's finger receives only the restoring force of the key return spring 37 as the reaction force, which gives an escapement-like feeling. As a result, a lighter key touch feeling is obtained during the strong key depression than during the weak key depression. However, at an early stage of the forward key stroke during the strong key depression, the reaction force of the increased inertial force of the key body 31 is transmitted to the player's finger, and hence the key touch feeling at this time is not lighter than during the weak key depression, whereby a massive key touch feeling is obtained.

Further, by appropriately changing the frictional state between the lower end 50*a* and the guide rail 40*a* such that, for example, the lower end 50*a* can easily slide on the guide rail 40*a*, the sliding frictional state can be shifted from the static frictional state into the dynamic frictional state at an early stage of the forward key stroke even during the weak key depression, almost without experiencing the static frictional state.

Further, when the same key is continually or repeatedly depressed, the key touch feeling-imparting mechanism is approximately in the state shown in FIG. 3C at the start of the second or subsequent key depression, and hence the sliding frictional state between the lower end 50*a* of the elastic engaging unit 50 and the guide rail 40*a* is immediately brought into the dynamic frictional state from the start of key depression without substantially experiencing the static frictional state. As a result, a smooth key-depressing operation is made possible.

According to the present embodiment, in the forward stroke of key depression, the amount of bend of the elastic engaging unit 50 increases (additional bend) when the lower end 50*a* thereof and the guide rail 40*a* are in the static frictional state, whereas when the sliding frictional state changes from the static frictional state into the dynamic frictional state, the additional bend is cancelled. This makes it possible to impart a definite and positive load change to the key body 31 due to an increase in the reaction force by the additional bend and a sudden decrease in the reaction force by a sudden decrease in the amount of bend. Particularly, the manner of the change in the frictional state varies depending on the intensity of key depression, and hence it is possible to obtain an excellent static let-off feeling during the weak key depression and a lighter key touch feeling during the strong key depression, except for the early stage of the forward key stroke during the strong key depression, than during the weak key depression, whereby it is possible to obtain such a natural key depression feeling dependent on the manner of key depression as obtained from an acoustic piano.

Now, a description will be given of the present embodiment from the viewpoint of elastic energy.

When the lower end 50*a* of the elastic engaging unit 50 and the guide rail 40*a* are in the static frictional state, due to the additional bend of the coil spring 51, elastic energy is stored in the coil spring 51. Then, when the sliding frictional state between the lower end 50*a* (pin 52) of the elastic engaging unit 50 and the guide rail 40*a* shifts from the static frictional state into the dynamic frictional state to cause the lower end 52*a* of the pin 52 to start sliding on the guide rail 40*a*, the coil spring 51 releases the stored elastic energy. The released elastic energy is transmitted to the player's finger as the reaction force. Thereafter, when the lower end 50*a* (pin 52) of the elastic engaging unit 50 falls off the rear end of the guide rail 40*a*, almost all the elastic energy stored in the coil spring 51 is released, so that only the returning force of the key return spring 37 is applied to the player's finger as the reaction force, which gives an escapement-like feeling.

In the above described way, in the forward key stroke, the reaction force applied to the finger can be definitely changed by storage of the elastic energy and subsequent release of the stored elastic energy. Further, the release of the elastic energy is caused by a change in the sliding frictional state between the pin 52 and the guide rail 40*a*, and hence, by configuring the keyboard apparatus such that the manner of change in the sliding frictional state between the frictional member of the elastic engaging unit and the receiving part depends on the intensity of key depression, it is possible to obtain a key depression feeling depending on the manner of key depression.

For example, if the maximum static frictional force between the pin 52 and the guide rail 40*a* is set to be large, the sliding frictional state between the pin 52 and the guide rail 40*a* does not promptly change from the static frictional state into the dynamic frictional state and the elastic energy is stored in the coil spring 51. The stored energy is released after a change from the static frictional state into the dynamic frictional state, so that the click feeling caused by a falling-off of the pin 52 from the guide rail 40 is masked, whereby an excellent dynamic let-off feeling is obtained.

Further, when the key depression is weak, the inertial force of the key body 31 is small, so that the stored elastic energy is small. Accordingly, the elastic energy released after a change from the static frictional state and the dynamic frictional state is small, so that the click feeling is not masked, whereby an excellent static let-off feeling is obtained.

Next, a description will be given of the present embodiment from the viewpoint of a engagement angle defined hereinbelow.

In the present embodiment, the engagement angle is defined as an angle θ formed between a line segment connecting between the contact point P0 (P1, P2) of the guide rail 40*a* and the pin 52 (see FIGS. 3A to 3D) and the point P of the upper end 51*b* of the coil spring 51 (see FIGS. 3A to 3D), and the guide rail 40*a*.

When the pin 52 and the guide rail 40*a* are in the static frictional state, the point P is shifted downward due to the additional bend of the coil spring 51, and hence the engagement angle progressively decreases. Subsequently, when the sliding frictional state between the pin 52 and the guide rail 40*a* changes from the static frictional state into the dynamic frictional state to cause the lower end 52*a* of the pin 52 to start sliding on the guide rail 40*a*, the contact point P1 moves rearward to causes a sudden decrease in the engagement angle.

As the engagement angle decreases, the reaction force from the coil spring applied to the finger decreases, so that the progressive decrease in the engagement angle ensures a smooth change in the reaction force applied to the finger. Further, the sudden decrease in the engagement angle is produced by a change in the sliding frictional state between the pin 52 and the guide rail 40*a*, and hence by configuring the keyboard apparatus such that the manner of change in the sliding frictional state between the pin 52 and the guide rail 40*a* varies depending on the intensity of key depression, it is possible to definitely change the reaction force applied to the finger. Particularly, the engagement angle becomes smaller in an late stage of the forward key stroke, which makes it possible to obtain an escapement-like feeling and hence a smooth let-off feeling.

Further, by configuring the keyboard apparatus such that until the pin 52 starts to slide on the guide rail 40*a*, the engagement angle hardly progressively decreases to allow the elastic energy to be stored in the coil spring 51, and once the pin 52 starts to slide on the guide rail 40*a*, the engagement angle progressively decreases as the forward key stroke proceeds. This makes it possible to obtain a definite change in the reaction force applied to the finger and subsequently an escapement-like feeling, and hence an excellent let-off feeling.

Further, a description will be given of the present embodiment from the viewpoint of a contact angle, defined hereinbelow.

In the present embodiment, the contact angle is defined as an angle θ' formed between the pin 52 and the guide rail 40*a*, more specifically, an angle formed between a side surface of the pin 52 and the guide rail 40*a* (see FIGS. 3A to 3D).

When the pin 52 and the guide rail 40*a* are in the static frictional state, the coil spring 51 is bent to protrude in the same direction as it was beforehand. At this time, the side surface of the pin 52 comes closer to the guide rail 40*a*, and hence the contact angle progressively decreases. Subsequently, when the sliding frictional state between the pin 52 and the guide rail 40*a* changes from the static frictional state into the dynamic frictional state to allow the end 52*a* of the pin 52 to start sliding on the guide rail 40*a*, the contact angle suddenly decreases due to a rearward movement of the pin 52.

When the contact angle decreases, the proportion of a rearward-acting component of the force of the coil spring 51 acting on the guide rail 40*a* increases, so that most of the elastic energy stored in the coil spring 51 can be released in the direction in which the finger does not receive the reaction force, which reduces the reaction force from the coil spring 51 applied to the finger. Therefore, a progressive decrease in the contact angle can cause a smooth change in the reaction force applied to the finger. Further, a sudden decrease in the contact angle is caused by a change in the sliding frictional state between the pin 52 and the guide rail 40*a*. Therefore, by configuring the keyboard apparatus such that the manner of change in the sliding frictional state between the pin 52 and the guide rail 40*a* depends on the intensity of key depression, it is possible to definitely change the reaction force applied to the finger. Particularly, the contact angle becomes smaller in a late stage of the forward key stroke, which makes it possible to obtain an escapement-like feeling and hence a smooth let-off feeling.

Further, since the key touch feeling-imparting mechanism TC1 is comprised of the elastic engaging unit 50 and the receiving part 40, it is unnecessary to use a heavy hammer arm or the like in imparting the key depression feeling, which not only simplifies the construction of the mechanism but also reduces the weight of the whole keyboard apparatus, as well as makes it possible to design the keyboard apparatus compact in size.

Further, the guide rail 40*a* of the receiving part 40 slopes down rearward, the elastic engaging unit 50, which is straight by itself, is disposed in a state preloaded into a bent state, and the lower end 50*a* thereof is engaged with the guide rail 40*a*. Therefore the direction of bend is always fixed, and the additional bend and return therefrom are smooth.

Although the elastic engaging unit 50 is configured to extend straight by itself, this is not limitative, but it may have a shape bent in a manner protruding forward by plastic deformation or the like in advance.

Although the elastic engaging unit 50 is disposed in a state bent in advance (before the start of key depression), this is not limitative, but it may be disposed in a state slightly bent so as to be buckled only in a fixed direction, whereby the elastic engaging unit 50 is buckled at the start of key depression. This obtains a more definite and positive change in the reaction force against key depression.

Further, as the pin 52, a pin with increased mass may be used to load the inertial force of the pin 52 on the coil spring 51 when the key is depressed. The inertial force increased during strong key depression causes the coil spring 51 to be bent at an early stage of the forward key stroke. This makes it possible to absorb the reaction force to be applied to the player's finger. Further, a large elastic energy can be stored in the coil spring 51. When a large elastic energy is stored, the elastic energy released after a change from the static frictional state into the dynamic frictional state can positively mask the aforementioned click feeling, which makes it possible to obtain an excellent let-off feeling.

Next, a description will be given of a second embodiment of the present invention.

Figure 4:
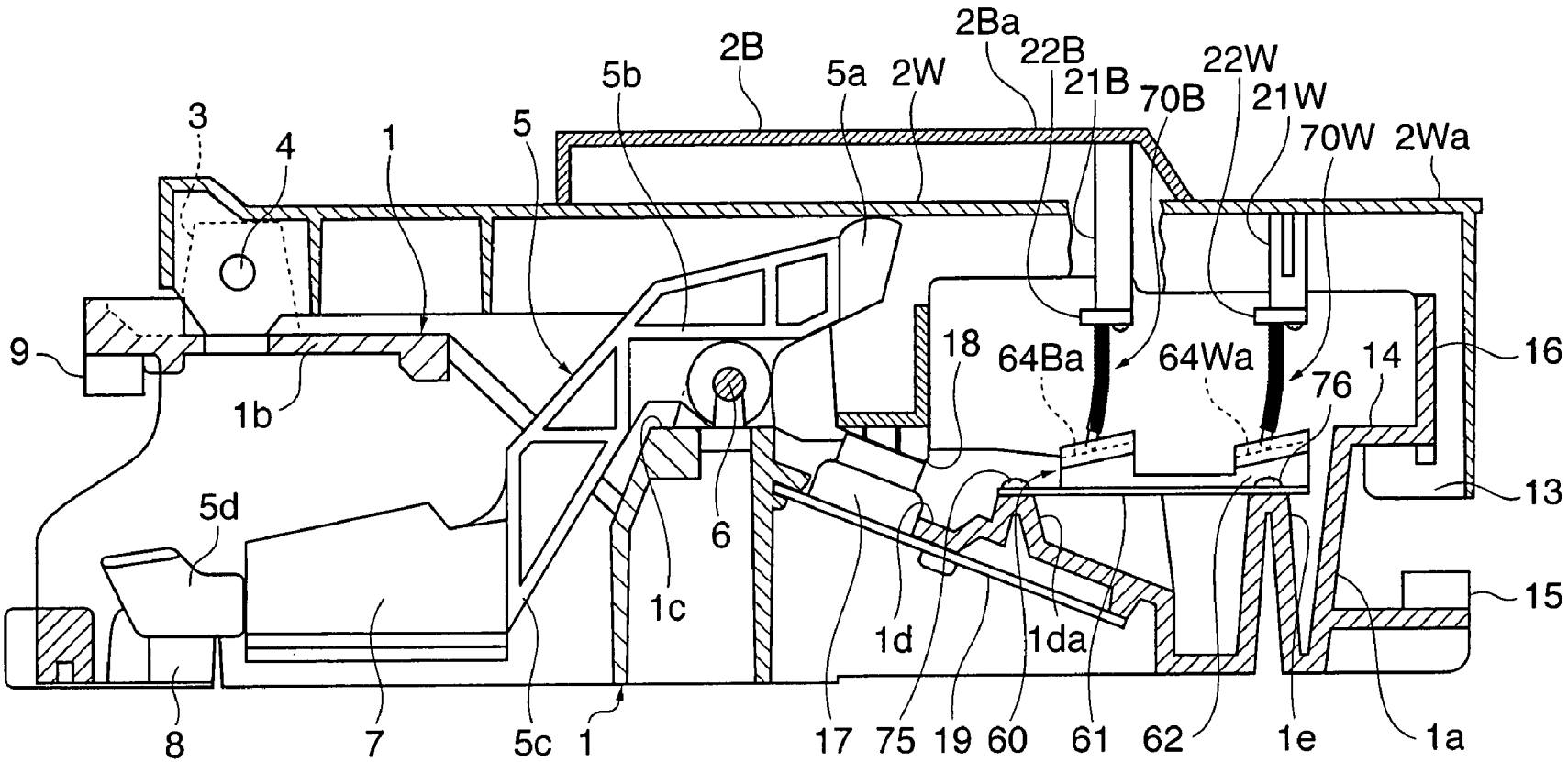
FIG. 4 is a longitudinal cross-sectional view of a keyboard apparatus according to a second embodiment of the present invention.

FIG. 4 is a longitudinal cross-sectional view of a keyboard apparatus according to the second embodiment of the present invention. The keyboard apparatus according to the present embodiment is distinguished from the first embodiment mainly in that the return spring 37 as the key return device is replaced by a hammer arm 5, and a common base 60 associated with a plurality of receiving parts 40 is configured as a single common body for all white keys and black keys. The right side in FIG. 4 will be referred to as "the front".

As shown in FIG. 4, the keyboard apparatus includes a keyboard chassis 1, and a plurality of keys 2 comprised of a plurality of white keys 2W and a plurality of black keys 2B are juxtaposed side by side on the keyboard chassis 1. In the following description, components associated with the white keys 2W and the black keys 2B and constructed similarly are designated by reference numerals with "W" and "B", as deemed appropriate. The white keys 2W and the black keys 2B are different in shape but have basically the same construction, and white keys 2W have the same construction. Therefore, hereinafter, a description will be given of the construction of one white key 2W as a representative.

The white key 2W has a rear end thereof pivotally mounted on a pivot 4 of a key support 3 provided on a rear end 1*b* of the keyboard chassis 1, for vertical pivotal (swinging) motion about the pivot 4. Further, at an intermediate part 1*c* of the keyboard chassis 1, a hammer support shaft 6 is disposed for vertically pivotally supporting the hammer arm 5. The hammer arm 5 is comprised of an upper end part 5*a*, an intermediate part 5*b*, and a lower end part 5*c*. The intermediate part 5*b* is pivotally supported on the hammer support shaft 6, and a weight 7 is provided on the lower end part 5*c* such that the mass of the weight 7 causes the upper end part 5*a* to be brought into abutment with the underside of the white key 2W, and always urges the white key 2W in a counterclockwise direction as viewed in FIG. 4.

In the non-key-depressed state of the key touch feeling-imparting mechanism shown in FIG. 4, the bottom of a protrusion 5*d* formed at a rear end of the lower end part 5*c* of the hammer arm 5 is in contact with a lower limit stopper 8 disposed on the keyboard chassis 1, thereby setting an initial position of the hammer arm 5 corresponding to the non-key-depressed state of the key touch feeling-imparting mechanism. Further, when the white key 2W is depressed against the gravitation of the weight 7, the top of the protrusion 5*d* of the hammer arm 5 is brought into abutment with an upper limit stopper 9 provided at the rear end 1*b* of the keyboard chassis 1, thereby setting a pivotal motion terminating position of the hammer arm 5 corresponding to the key depression-terminated state of the key touch feeling-imparting mechanism.

At a front end 1*a* of the keyboard chassis 1, there are provided an upper limit stopper 14 and a lower limit stopper 15. An L-shaped stopper abutment piece 13 is formed at the front end of the white key 2W in a manner suspended therefrom. When the white key 2W is in a non-depressed state, the stopper abutment piece 13 is brought into abutment with the upper limit stopper 14, thereby setting an upper limit position, i.e. the non-key-depressed position of the white key 2W, and when the white key 2W is strongly depressed, the stopper abutment piece 13 is brought into abutment with the lower limit stopper 15, thereby setting a lower limit position, i.e. a pivotal motion-terminated position of the white key 2W when strongly depressed. Further, the white key 2W is guided by a key guide 16 provided on the front end 1*a* of the keyboard chassis 1 so as to be prevent from being laterally displaced.

At a longitudinally intermediate part of the keyboard chassis 1, a circuit board 19 is supported by a key switch base 1*d*, and a key depression switch 17 is provided on the circuit board 19, as a sensor for detecting key-depressed and key-released states and a key-being-depressed state. Further, a switch pressing part 18 is provided on the white key 2W in opposed relation to the key switch 17, for pressing the key switch 17. The key switch 17 detects key-depressing and key-releasing operations performed by the user on the white key 2W. The components of the black key 2B are constructed similarly to the corresponding components of the white key 2W, though partly not shown.

The common base 60 is disposed between the intermediate part 1*c* of the keyboard chassis 1 and the front end 1*a* thereof at a location between the key switch base 1*d* and the lower limit stopper 15 in the longitudinal direction of the key body 31. Further, the common base 60 is disposed in a manner vertically overlapping the key switch base 1*d* and the circuit board 19. This makes it possible to dispose the common base 60 in a manner making effective use of space while avoiding interference with essential key function parts, such as the upper limit stopper 9, the stopper abutment piece 13, and the pivot 4, thereby enabling the keyboard apparatus to be designed compact in size through space saving.

The key switch base 1*d* is comprised of a first attachment part 1*da* and a second attachment part 1*e* forward of the first attachment part 1*da*, which are in the form of ridges or a boss circular in plan view and formed by protuberating parts of the keyboard chassis 1. A support member 61 is fixed to the first attachment part 1*da* and the second attachment part 1*e* with screws 75 and 76 (see also FIG. 5A), whereby the common base 60 is supported on the keyboard chassis 1. Therefore, the key switch base 1*d* also serves as a mounting part for mounting the common base 60 and the circuit board 19. When the first attachment part 1*da* and the second attachment part 1*e* are formed as ridges and extended in a direction along the depth as viewed in FIG. 4, they also serve to reinforce the keyboard chassis 1 in the direction of juxtaposition of the keys.

Further, suspended parts 21W and 21B are formed on the respective key operating parts 2W*a* and 2B*a* of the white key 2W and the black key 2B in a manner suspended down therefrom, and have fixing members 22W and 22B provided at lower ends thereof, respectively. Fixed to the fixing members 22W and 22B are elastic engaging units 70 (70W and 70B) corresponding to the elastic engaging unit 50, in a manner suspended down therefrom.

Figure 5A:
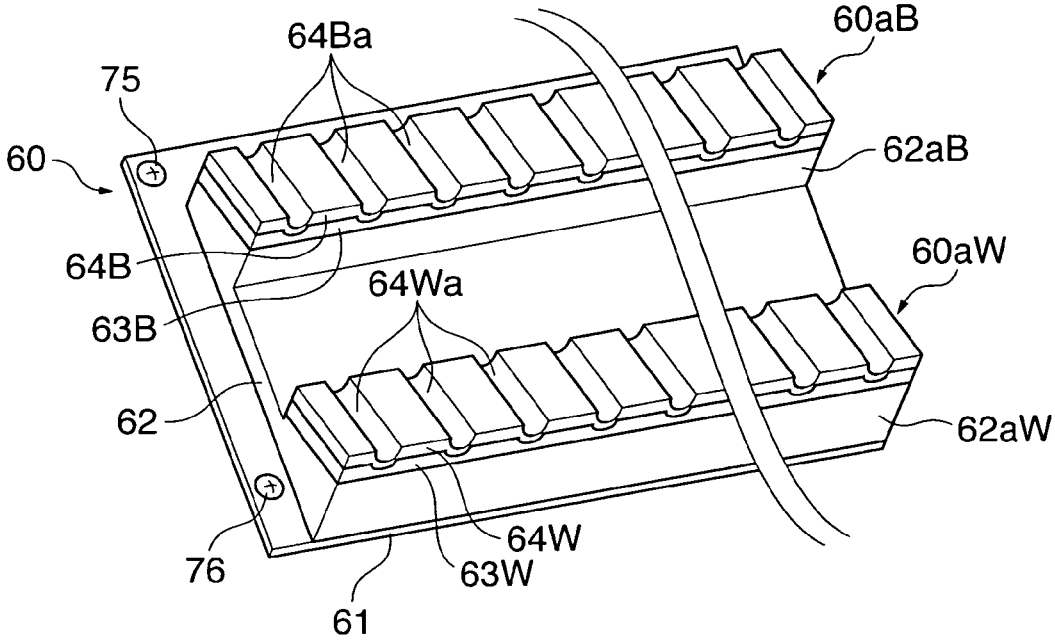
Figure 5B:
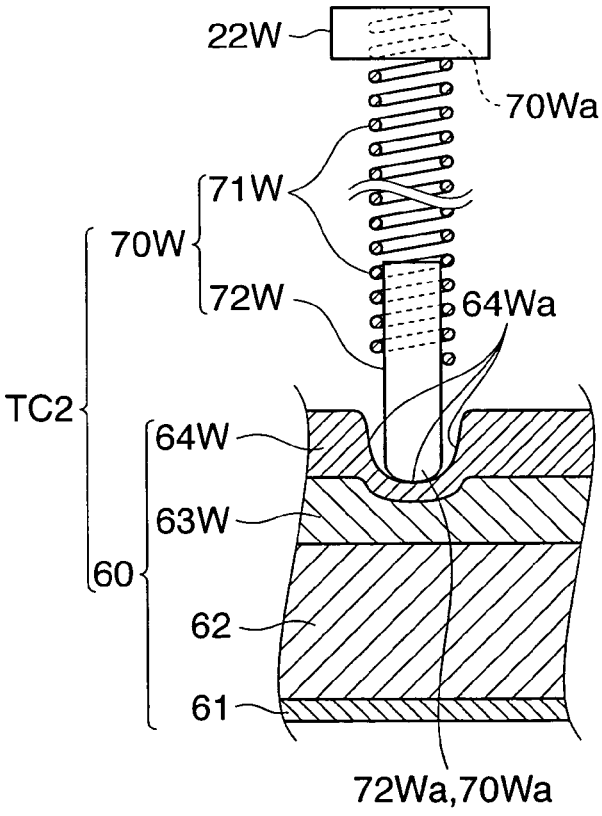
Figure 5C:
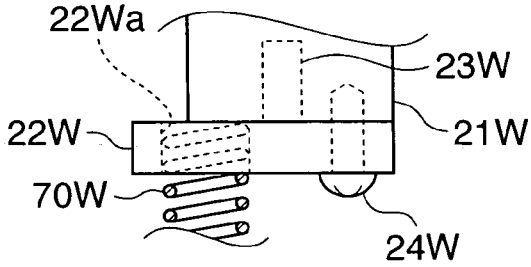

FIG. 5A is a perspective view of the common base 60; FIG. 5B is a fragmentary cross-sectional view showing the construction of a part of a key touch feeling-imparting mechanism TC2 associated with a white key 2W; and FIG. 5C is a side view of a mounting part of the part of the key touch feeling-imparting mechanism TC2 associated with the white key 2W via which the associated part of the key touch feeling-imparting mechanism TC2 is mounted on the fixing member 22W.

The common base 60 is provided in association with a plurality (e.g. corresponding to one octave) of white keys 2W and black keys 2B, and a plurality of common bases 60 cover all the white keys 2W and black keys 2B of the keyboard apparatus. The common base 60 may be configured such that the single common base 60 covers all the keys.

In the present embodiment, the key touch feeling-imparting mechanism TC2 is comprised of all the common bases 60 and all the elastic engaging units 70W and 70B. First, as shown in FIGS. 5A and 5B, a single common base 60 is comprised of a plate-like support member 61, a base 62, first attachment members 63 (63W and 63B) formed e.g. of felt, and second attachment members 64 (64W and 64B) formed e.g. of felt. The support member 61 and the base 62 are provided commonly for a plurality of white keys 2W and black keys 2B associated with one common base 60. The first attachment member 63W and the second attachment member 64W are provided commonly for the aforementioned plurality of white keys 2W and the first attachment member 63B and the second attachment member 64B are provided commonly for the aforementioned plurality of black keys 2B.

The support member 61 is formed of a robust material, such as metal, and as shown in FIG. 4, after attaching the base 62 and other parts thereto, the support member 61 is fixed to the keyboard chassis 1. The base 62 is fixed to the support member 61 with an adhesive and screws 75 and 76. As shown in FIG. 5A, the base 62 has a white key ridge 62*a*W and a black key ridge 62*a*B formed thereon. The white key ridge 62*a*W and the black key ridge 62*a*B are formed at locations below the key operating parts 2W*a* of the white keys 2W and the key operating parts 2B*a* of the black keys 2B, and are arranged side by side in the direction of juxtaposition of the keys. The first attachment members 63W and 63B are fixed to the white key ridge 62*a*W and the black key ridge 62*a*B, respectively, with an adhesive or the like. Further, the second attachment members 64W and 64B are fixedly bonded to the first attachment members 63W and 63B, respectively, e.g. with a resilient adhesive or double-faced tape.

The second attachment members 64W and 64B are formed with guide rails 64*a* (64W*a* and 64B*a*) as groove-like recesses similar to the guide rail 40*a*, in a manner associated with the white keys 2W and the black keys 2B, respectively. Therefore, blocks formed respectively by the white key and black key ridges 62*a*W and 62*a*B, the first attachment members 63W and 63B, and the second attachment members 64W and 64B are referred to as a white key-receiving block 60*a*W and a black key-receiving block 60*a*B. The white key-receiving block 60*a*W and the black key-receiving block 60*a*B correspond to a plurality of receiving parts as the receiving part 40 of the first embodiment.

The first attachment member 63W and the second attachment member 64W are made e.g. in the following manner: Nonwoven fabric which is elongated and wide is cut to a predetermined width, and the resulting strip of the nonwoven fabric is placed on the top of a lower die formed with projections and depressions corresponding to the guide rails 64W*a* and 64B*a*, and is subjected to press forming using the lower die and an upper die formed with depressions and projections in fitting relationship with the depressions and the projections of the upper die. The depth of the guide rails 64W*a* and 64B*a* can be adjusted by the sizes of the projections and depressions of the lower and upper dies and the pressure applied during the press forming.

On the other hand, as shown in FIG. 5B, the elastic engaging unit 70W is comprised of a coil spring 71W and a pin 72W, similarly to the elastic engaging unit 50. As shown in FIG. 5C, the fixing member 22W is formed with a fixing protrusion 23W and the fixing protrusion 23W is press-fitted in the suspended part 21W, and at the same time the fixing member 22W is fixed to the suspended part 21W with screws 24W. Further, the method of fixing the upper end of the elastic engaging unit 70W into a fixing hole 22W*a* of the fixing member 22W is the same as employed when the upper end 50*b* (upper end 51*b*) of the elastic engaging unit 50 is fixed into the fitting hole 31*ab* of the key operating part 31*a* of the key body 31, but the method is not limited to this.

The construction of the lower half of the elastic engaging unit 70W is quite the same as that of the elastic engaging unit 50 used in the first embodiment, and a lower end 72W*a* of the pin 72W corresponding to a lower end 70W*a* of the elastic engaging unit 70W is in slidable contact with the guide rail 64W*a*. The elastic engaging unit 70B corresponding to the black key 20B and parts associated therewith, not shown, are constructed similarly to the elastic engaging unit 70W.

With this construction, the engagement relationship between the elastic engaging unit 70W and the guide rail 64W*a* is the same as that between the elastic engaging unit 50 and the guide rail 40*a* in the first embodiment.

According to the present embodiment, it is possible to obtain the same advantageous effects as provided by the first embodiment with a simplified construction, that is, imparting a natural key depression feeling with a definite and positive load change.

What is more, in addition to the reaction force by the elastic engaging unit 70, the inertia of the hammer arm 5 contributes to imparting a key touch feeling sensed by the user's finger, whereby a resistance-offering key touch feeling is sensed in response to key depression, which obtains a dynamic key touch feeling closer to that given by an acoustic piano. Further, during the strong key depression, the inertial force of the hammer arm 5 which is increased by the strong key depression can mask the click feeling caused by falling-off of the pins 72W and 72B from the guide rails 64W*a* and 64B*a*, which makes it possible to obtain an excellent dynamic let-off feeling.

Further, according to the present embodiment, the white key- and black key-receiving parts 60*a*W and 60*a*B corresponding to a plurality of receiving parts as the receiving part 40 of the first embodiment are shared by the white keys 2W and the black keys 2B, and hence compared with the case of forming the receiving parts separately, the construction is simplified. Besides, since the white key-receiving part 60*a*W and the black key-receiving part 60*a*B are each formed in one body extending in the direction of juxtaposition of the keys, whereby the guide rails 64*a* are uniform in height, and variations in key depression feeling between the associated white keys 2W and between the associated black keys 2B can be suppressed.

Although in the first and second embodiments, the guide rails are formed to slope down rearward, but the direction of sloping is not limited to this. For example, the guide rails may be formed to slope down forward, and the bending of the elastic engaging units 50 and the additional bend may be directed rearward in association therewith.

Further, as the pins 72W and 72B, pins with increased mass may be used to load the inertial forces thereof on the coil springs 71W and 71B during key depression. The inertial forces increased during the strong key depression cause the coil springs 71W and 71B to be bent at an early stage of the forward key stroke. This makes it possible to absorb the reaction force applied to the player's finger. Further, a large elastic energy can be stored in each of the coil springs 71W and 71B. The storage of the large elastic force enables the elastic energy released after a change from the static frictional state into the dynamic frictional state to mask the aforementioned click feeling, which makes it possible to obtain an excellent dynamic let-off feeling.

Next, a description will be given of a third embodiment of the present invention.

A keyboard apparatus according to the third embodiment of the present invention is distinguished from the keyboard apparatus according to the second embodiment in the constructions of the key touch feeling-imparting mechanism, fixing members associated therewith, and the like, but otherwise has the same construction as that of the second embodiment.

Figure 6A:
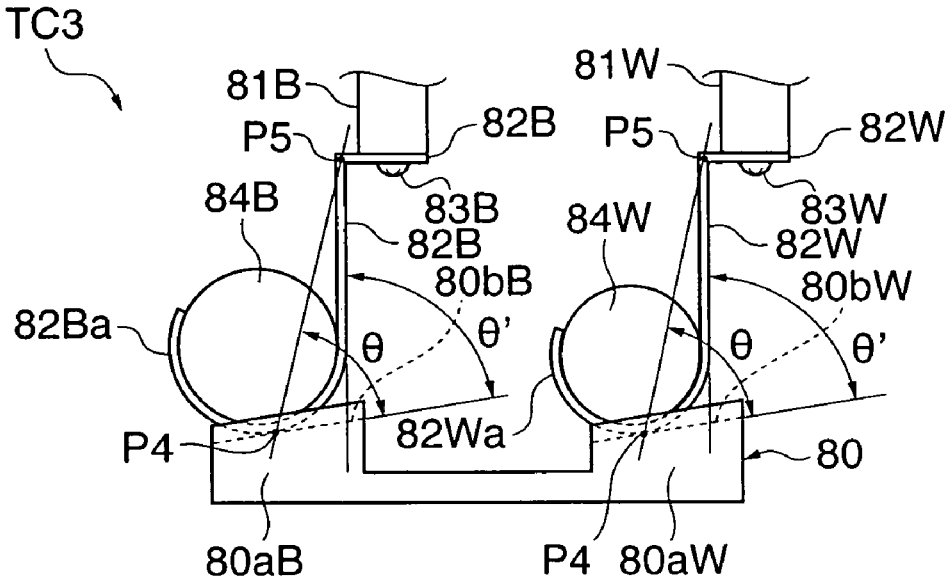
Figure 6B:
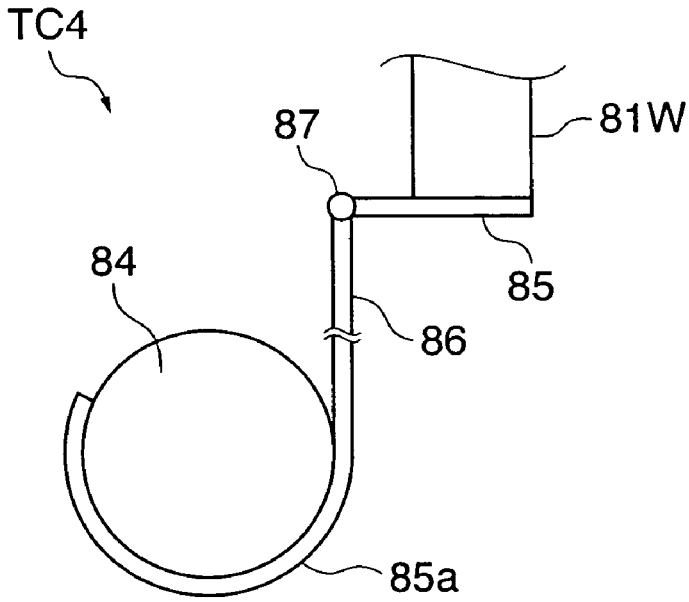

FIG. 6A is a side view of a key touch feeling-imparting mechanism TC3 of the keyboard apparatus according to the third embodiment. FIG. 6B is a fragmentary side view of a key touch feeling-imparting mechanism TC4 as a variation of the keyboard apparatus according to the third embodiment.

A common base 80 shown in FIG. 6A is constructed similarly to the common base 60 of the second embodiment, and has a white key-receiving part 80*a*W and a black key-receiving part 80*a*B corresponding to the white key-receiving part 60*a*W and the black key-receiving part 60*a*B of the second embodiment. The white key-receiving part 80*a*W and the black key-receiving part 80*a*B are formed with the same guide rails 80*b* (80*b*W and 80*b*B) similar to the guide rails 64W*a* and 64B*a* of the second embodiment.

Further, in the present embodiment, in place of the elastic engaging unit 70, there are provided leaf springs 82 (82W and 82B). The leaf springs 82 (82W and 82B) have respective upper ends thereof formed into the shape of "L" and respective lower halves thereof formed into the shape of "J". Disc-shaped weights 84W and 84B are fixedly held on lower parts or arcuate parts 82W*a* and 82B*a* of the J-shaped halves. The weights 84W and 84B are different in weight and size from each other, and to obtain a key depression feeling uniform between the white keys 2W and the black keys 2B, the size of the weight 84B is larger than that of the weight 84W.

The upper ends of the leaf springs 82W and 82B are fixed to suspended parts 81W and 81B also corresponding to the suspended parts 21W and 21B, with screws 83W and 83B. The lower ends of the arcuate parts 82W*a* and 82B*a* of the leaf springs 82W and 82B are in slidable contact with the guide rails 80*b*W and 80*b*B of the common base 80, similarly to the relationship between the pins 72W and the respective guide rails 64W*a* of the second embodiment.

With this construction, as is distinct from the above-described embodiments, not the coil springs but the leaf springs are used as the component elements of the elastic engaging unit, which increases a change in the reaction force dependent on the manner of key depression. Further, with this construction, when a key-depression operation is performed, similarly to the second embodiment, first, the arcuate part 82W*a* or 82B*a* of the leaf spring 82W or 82B initially engages with the associated guide rail 80*b*W or 80*b*B in a static frictional state, and the leaf spring 82W or 82B becomes bent to protrude forward, and then the sliding frictional state between the engaged members changes into a dynamic frictional state, and finally, the arcuate part 82W*a* or 82B*a* falls off the associated guide rail 80*b*W or 80*b*B. Therefore, the manner of production of the reaction force by bending of the flat-plate spring 82W or 82B is the same as in the second embodiment. Parts of the leaf springs 82W and 82B lying between the upper ends thereof and the arcuate parts 82W*a* and 82B*a* extend almost straight from the start when the leaf springs 82W and 82B are initially mounted, and hence bending thereof caused by key depression is similar to a phenomenon of buckling.

However, according to the present embodiment, the weights 84W and 84B are held by the respective associated arcuate parts 82W*a* and 82B*a*, and hence inertia is applied to the key 2, which makes it possible to obtain a key depression feeling reflecting the inertia. Further, since the elastic engaging unit is implemented by the leaf spring 82W or 82B, the direction of bending of the elastic engaging unit is stably fixed and the leaf spring is never laterally bent, which ensures a smooth bending operation of the leaf spring. This makes the user's finger less liable to ache when it is used in continual or repeated depression of a key. Since the direction of bending of the elastic engaging unit is stably fixed, in the present embodiment, the guide rails 80*b*W and 80*b*B need not be shaped in the form of a groove, but may be configured to provide only sliding surfaces.

The present embodiment provides not only the same advantageous effects as provided by the second embodiment but also makes it possible to realize a more natural key depression feeling by applying inertia to the key 2 itself.

Now, a description will be given of the present embodiment from the viewpoint of elastic energy.

When the arcuate part 82*a* of the leaf spring 82 and the guide rail 64*a* are in the static frictional state, due to the bend of the leaf spring 82, elastic energy is stored in the leaf spring 82. Then, when the sliding frictional state between the arcuate part 82*a* of the leaf spring 82 and the guide rail 64*a* shifts from the static frictional state into the dynamic frictional state to cause the arcuate part 82*a* to start sliding on the guide rail 64*a*, the leaf spring 82 releases the stored elastic energy. The released elastic energy is transmitted to the player's finger as the reaction force. Thereafter, when the arcuate part 82*a* of the arcuate part 82*a* falls off the rear end of the guide rail 64*a*, almost all the elastic energy stored in the leaf spring 82 is released, so that only the returning force produced by the gravitation of the weight 7 is applied to the player's finger as the reaction force, which gives an escapement-like feeling.

In the above described way, in the forward key stroke, the reaction force applied to the finger can be definitely changed by storage of the elastic energy and subsequent release of the stored elastic energy. Further, the release of the elastic energy is caused by a change in the sliding frictional state between the arcuate part 82*a* and the guide rail 64*a*, and hence, by configuring the keyboard apparatus such that the manner of change in the sliding frictional state between the frictional member of the elastic engaging unit and the receiving part depends on the intensity of key depression, it is possible to obtain a key depression feeling depending on the manner of key depression.

For example, if the mass of the weight 84 is set to be large (e.g. to a weight of 5 to 100 gram-weight), when the key depression is strong, the inertial mass of the weight 84 acts on the leaf spring 82 in the forward key stroke to prevent the leaf spring 82 from moving, so that the sliding frictional state between the arcuate part 82*a* and the guide rail 64*a* does not promptly change from the static frictional state into the dynamic frictional state and the elastic energy is stored in the leaf spring 82. The stored energy is released after a change from the static frictional state into the dynamic frictional state, so that the click feeling caused by falling-off of the arcuate part 82*a* from the guide rail 64*a* is masked. Further, at an early stage of the forward key stroke, the leaf spring 82 is likely to bend, and hence the reaction force applied to the player's finger can be absorbed. Then, when the arcuate part 82*a* falls off the guide rail 64*a*, only the returning force produced by the gravitation of the weight 7 is applied to the player's finger as the reaction force, which makes it possible to obtain an escapement-like feeling.

In the above described way, an excellent dynamic let-off feeling can be obtained.

On the other hand, when the key depression is weak, the inertial force of the weight 84 is small, so that the bend of the leaf spring 82 is small. The reaction force applied to the player's finger at an early stage of the forward key stroke is formed only by the returning force produced by the gravitation of the weight 7 and the reaction force of the leaf spring 82. Further, during the weak key depression, the amount of bend of the leaf spring 82 is small, and hence the stored elastic energy is small, so that the click feeling is not masked. Subsequently, when only the returning force produced by the gravitation of the weight 7 is applied to the player's finger as the reaction force, whereby an escapement-like feeling is obtained.

Thus, during the weak key depression, it is possible to obtain an excellent let-off feeling.

Next, a description will be given of the present embodiment from the viewpoint of a engagement angle defined hereinbelow.

In the present embodiment, the engagement angle based is defined as an angle θ formed between a line segment connecting between the contact point P4 of the guide rail 64*a* and the arcuate part 82*a* (see FIG. 6A) and the point P5 of the upper end of the leaf spring 82 (see FIG. 6A), and the guide rail 64*a*.

When the arcuate part 82*a* and the guide rail 64*a* are in the static frictional state, the point P5 is shifted downward due to the bend of the leaf spring 82, and hence the engagement angle progressively decreases. Subsequently, when the sliding frictional state between the arcuate part 82*a* and the guide rail 64*a* changes from the static frictional state into the dynamic frictional state to cause the arcuate part 82*a* to start sliding on the guide rail 64*a*, the contact point P4 moves rearward to causes a sudden decrease in the engagement angle.

When the engagement angle decreases, the reaction force from the leaf spring 82 applied to the finger decreases, so that a progressive decrease in the engagement angle ensures a smooth change in the reaction force applied to the finger. Further, a sudden decrease in the engagement angle is produced by a change in the sliding frictional state between the arcuate part 82*a* and the guide rail 64*a*, and hence, by adjusting the mass of the weight 84, the inertial force thereof acting on the leaf spring 82 can be adjusted whereby it is possible to control the manner of change in the sliding frictional state between the arcuate part 82*a* and the guide rail 64*a* dependent on the intensity of key depression. Therefore, by adjusting the mass of the weight 84, it is possible to definitely change the reaction force applied to the finger. Particularly, the engagement angle becomes smaller in an late stage of the forward key stroke, which makes it possible to obtain an escapement-like feeling and hence a smooth let-off feeling.

Further, the keyboard apparatus may be configured such that until the arcuate part 82*a* starts to slide on the guide rail 64*a*, the engagement angle hardly progressively decreases to assist storage of the elastic energy in the leaf spring 82, and once the arcuate part 82*a* starts to slide on the guide rail 64*a*, the engagement angle progressively decreases as the forward key stroke proceeds. This makes it possible to obtain a definite change in the reaction force applied to the finger and subsequently an escapement-like feeling, and hence an excellent let-off feeling.

Further, a description will be given of the present embodiment from the viewpoint of a contact angle defined hereinbelow.

In the present embodiment, the contact angle based is defined as an angle θ' formed between the leaf spring 82 and the guide rail 64*a*, more specifically, an angle formed between the top of the arcuate part 82*a* of the leaf spring 82 and the guide rail 64*a* (see FIG. 6A).

When the arcuate part 82*a* and the guide rail 64*a* are in the static frictional state, the leaf spring 82 is bent to protrude forward. At this time, the contact angle progressively decreases. Subsequently, when the sliding frictional state between the arcuate part 82*a* and the guide rail 64*a* changes from the static frictional state into the dynamic frictional state to allow the arcuate part 82*a* to start sliding on the guide rail 64*a*, the contact angle suddenly decreases due to a rearward movement of the arcuate part 82*a*.

As the contact angle decreases, the reaction force from the leaf spring 82 applied to the finger decreases, and hence, a progressive decrease occurs in the contact angle to smoothly change the reaction force applied to the finger. Further, a sudden decrease in the contact angle is caused by a change in the sliding frictional state between the arcuate part 82*a* and the guide rail 64*a*. Therefore, by adjusting the mass of the weight 84, the inertial force thereof acting on the leaf spring 82 can be adjusted, whereby it is possible to control the manner of change in the sliding frictional state between the arcuate part 82*a* and the guide rail 64*a* dependent on the intensity of key depression. Therefore, by adjusting the mass of the weight 84, it is possible to definitely change the reaction force applied to the finger. Particularly, the contact angle becomes smaller in a late stage of the forward key stroke, which makes it possible to obtain an escapement-like feeling and hence a smooth let-off feeling.

To make the bending of the leaf springs 82W and 82B more stable, the leaf springs 82W and 82B may be bent beforehand (before the start of key depression), similarly to the second embodiment, such that they protrude rearward. In this case, the leaf springs 82W and 82B may be straight by itself, but may also be bent beforehand by plastic deformation or the like.

For both the white keys and the black keys, as in the case of the key touch feeling-imparting mechanism TC4 shown in FIG. 6B, the leaf springs 82W and 82B, each of which is formed in one body, may be replaced by units comprised of a first plate 85 and a second plate 86 which are formed of rigid materials, and a hinge 87 pivotally connecting the first plate 85 and the second plate 86. With this construction, even when key depression is performed, buckling or bending of the second plate 86 does not occur, but due to rotation of the second plate 86 about the hinge 87, the arcuate part 85*a* holding the weight 84 slides on the guide rail 80*b*, and the friction between the arcuate part 85*a* and the guide rail 80*b* produces a reaction force. Then, when the arcuate part 85*a* falls off the guide rail 80*b*, the reaction force suddenly decreases. By properly setting the friction between the arcuate part 85*a* and the guide rail 80*b*, it is possible to adjust the key depression feeling. Further, since the key 2 itself is given inertia, it is possible to realize a more natural key depression feeling.

The first plate 85 and the second plate 86 may be connected via a small thin plate having resiliency instead of the hinge 87.

In the present embodiment, the second plate 86 is connected to the suspended part 81 via the first plate 85, and the second plate 86 and the suspended part 81 do not align. However, the second plate 86 may be directly connected to the suspended part 81, and the second plate 86 and the suspended part 81 may align, whereby the static frictional state can be maintained for a long time when the key is depressed. As a result, it is possible to enhance the click feeling.

In the first and second embodiments as well, similarly to the case of the third embodiment shown in FIG. 6A, leaf springs may be used, in place of the elastic engaging units 50 and 70 to thereby omit the guide rails 40*a* and 64*a*.

In the first and second embodiments as well, a weight similar to the weight 84 in the third embodiment may be provided.

Although in the first to third embodiments, the resilient member that buckles or bends, which is used in the elastic engaging unit, is not limited to the coil spring or the leaf spring, but any suitable member that can buckle or bend, such as rubber and an assembly of lots of wire-like members, may be used.

Although, in the first to third embodiments, the guide rail is formed with the groove-like recess, the guide rail may be formed with a convex rail projected from the receiving part, and in this case, the engaging unit may have a groove in which the convex rail can be slidably fitted.

What is claimed is:

1. A keyboard apparatus comprising:

a support member;

a plurality of pivots that are provided on said support member;

a plurality of keys that are each pivotally supported on said support member for pivotal movement about an associated one of said pivots, said plurality of keys each having a key operating part;

a key return device that imparts a returning habit to each of said keys such that the key returns into a non-depressed state when the key is not depressed; and a key touch feeling-imparting mechanism that imparts a predetermined feeling characteristic to each of said keys when the key is depressed, wherein said key touch feeling-imparting mechanism comprises a receiving part that is provided on said support member, and an elastic engaging unit that has one end thereof held by said key operating part of an associated one of said keys and another end thereof slidably engaged with said receiving part, and wherein said elastic engaging unit is disposed such that said elastic engaging unit is bent during a forward stroke of key depression caused by a key depressing operation to give a reaction force to said associated key, and said elastic engaging unit moves such that the other end thereof starts to slide on said receiving part due to a change in a sliding frictional state between the other end thereof and said receiving part during the forward stroke of key depression so as to suddenly decrease in an amount of bend thereof to thereby decrease the reaction force given to said associated key.

2. A keyboard apparatus as claimed in claim 1, wherein said elastic engaging unit is disposed such that said elastic engaging unit is bent when the other end thereof and said receiving part are in a static frictional state, and said elastic engaging unit suddenly decreases in an amount of bend thereof as the sliding frictional state between the other end thereof and said receiving part is changed from the static frictional state into a dynamic frictional state.

3. A keyboard apparatus as claimed in claim 1, wherein said elastic engaging unit is disposed such that said elastic engaging unit is bent in one direction when said associated key is in the non-depressed state, and said elastic engaging unit is further deeply bent in the one direction when said key is depressed.

4. A keyboard apparatus as claimed in claim 1, wherein said elastic engaging unit comprises a spring member, and said spring member stores elastic energy when said receiving part and the other end of said elastic engaging unit are frictionally engaged with each other, and releases the stored elastic energy when a frictional state between the other end of said elastic engaging unit and said receiving part has changed during the forward stroke of key depression.

5. A keyboard apparatus comprising:

a support member;

a plurality of pivots that are provided on said support member;

a plurality of keys that are each pivotally supported on said support member for pivotal movement about an associated one of said pivots, said keys comprising a plurality of white keys and a plurality of black keys, said keys each having a key operating part;

a key return device that imparts a returning habit to each of said keys such that the key returns into a non-depressed state when the key is not depressed;

a key touch feeling-imparting mechanism that imparts a predetermined feeling characteristic to each of said keys when the key is depressed; and a mass member provided in association with each of said keys, for movement in response to an operation of an associated one of said keys, wherein said key touch feeling-imparting mechanism comprises a receiving part that is provided on said support member, and an elastic engaging unit that has one end thereof held by said key operating part of an associated one of said keys and another end thereof slidably engaged with said receiving part, wherein said elastic engaging unit is disposed such that said elastic engaging unit is bent during a forward stroke of key depression caused by a key depressing operation to give a reaction force to said associated key, and said elastic engaging unit suddenly decreases in an amount of bend thereof due to a change in a sliding frictional state between the other end thereof and said receiving part during the forward stroke of key depression, to thereby decrease the reaction force given to said associated key, and wherein each of said keys, said mass member, and said key touch feeling-imparting mechanism are arranged such that a key touch feeling caused by the reaction force and inertia of said mass member is transmitted to an operator's finger via the key associated with said mass member, when the key is depressed.

6. A keyboard apparatus comprising:

a support member;

a plurality of keys that are pivotally supported on said support member, said keys comprising a plurality of white keys and a plurality of black keys, said keys each having a free end, and a key operating part;

a key return device that imparts a returning habit to each of said keys such that the key returns into a non-depressed state when the key is not depressed;

a key stopper that is provided in association with the free end of each of said keys, for abutment with an associated one of said keys to set a key depression-terminated position of key depression of the key;

a key touch feeling-imparting mechanism that imparts a predetermined feeling characteristic to each of said keys when the key is depressed;

a plurality of key operation-detecting sensors that are provided in association with respective ones of said keys, each of said key operation-detecting sensors being driven by an associated one of said keys to detect an operation of the key; and a sensor holding member that is held on said support member and holds said key operation-detecting sensors, wherein said key touch feeling-imparting mechanism comprises a receiving part that is provided on said support member, and an elastic engaging unit that has one end thereof held by said key operating part of an associated one of said keys and another end thereof slidably engaged with said receiving part, and said key touch feeling-imparting mechanism is disposed between said key stopper and said sensor holding member in a longitudinal direction of the associated one of said keys.

7. A keyboard apparatus comprising:

a support member;

a plurality of pivots that are provided on said support member;

a plurality of keys that are each pivotally supported on said support member for pivotal movement about an associated one of said pivots, said keys comprising a plurality of white keys and a plurality of black keys, said keys each having a key operating part;

a key return device that imparts a returning habit to each of said keys such that the key returns into a non-depressed state when the key is not depressed; and a key touch feeling-imparting mechanism that imparts a predetermined feeling characteristic to each of said keys when the key is depressed, wherein said key touch feeling-imparting mechanism comprises a receiving member that is provided on said support member, and a reaction force-imparting member that is disposed in association with each of said keys, for cooperating with said receiving member to impart a reaction force to an associated one of said keys when the key is depressed, said reaction force-imparting member moving relative to said receiving member to thereby change an amount of the reaction force imparted to said associated key, and wherein said receiving member is formed in one body having a white key-receiving part provided for an associated one of said white keys and a black key-receiving part provided for an associated one of said black keys, and said white key-receiving part and said black key-receiving part are juxtaposed, below said key operating part of the associated one of said white keys and said key operating part of the associated one of said black keys in a direction of juxtaposition of said keys.

8. A keyboard apparatus comprising:

a support member;

a plurality of pivots that are provided on said support member;

a plurality of keys that are each pivotally supported on said support member for pivotal movement about an associated one of said pivots;

a key return device that imparts a returning habit to each of said keys such that the key returns into a non-depressed state when the key is not depressed; and a key touch feeling-imparting mechanism that imparts a predetermined feeling characteristic to each of said keys when the key is depressed, wherein each of said keys has a key operating part, wherein said key touch feeling-imparting mechanism comprises a receiving part that is provided on said support member, and an elastic engaging unit that has one end thereof held by said key operating part of an associated one of said keys, wherein said elastic engaging unit comprises a member that is capable of storing elastic energy, and a frictional member that is slidably engaged with said receiving part disposed at another end of said elastic engaging unit, and wherein said elastic engaging unit is disposed such that said elastic engaging unit stores elastic energy when said receiving part and said frictional member are frictionally engaged with each other, and releases the stored elastic energy due to a change in a frictional state between said frictional member and said receiving part during a forward stroke of key depression.

9. A keyboard apparatus as claimed in claim 8, wherein said elastic engaging unit releases the stored elastic energy when said elastic member starts to slide on said receiving part.

10. A keyboard apparatus as claimed in claim 9, wherein said elastic engaging unit changes a degree of release of the stored elastic energy according to a manner of key depression.

11. A keyboard apparatus comprising:

a support member;

a plurality of pivots that are provided on said support member;

a plurality of keys that are each pivotally supported on said support member for pivotal movement about an associated one of said pivots;

a key return device that imparts a returning habit to each of said keys such that the key returns into a non-depressed state when the key is not depressed; and a key touch feeling-imparting mechanism that imparts a predetermined feeling characteristic to each of said keys when the key is depressed, wherein each of said keys has a key operating part, wherein said key touch feeling-imparting mechanism comprises a receiving part that is provided on said support member, and an elastic engaging unit that has one end thereof held by said key operating part of an associated one of said keys, wherein said receiving part slopes with respect to the key depression direction, wherein said elastic engaging unit comprises a member that is capable of storing elastic energy, and a frictional member that is slidably engaged with said receiving part disposed at another end of said elastic engaging unit, and wherein said receiving part and said elastic engaging unit are disposed such that an angle formed between a line segment connecting between a contact point of said receiving part and said frictional member and the one end of said elastic engaging unit, and said receiving part progressively decreases as a forward stroke of key depression proceeds.

12. A keyboard apparatus as claimed in claim 11, wherein said receiving part and said elastic engaging unit are disposed such that said frictional member starts to slide on said receiving part during the forward stroke of key depression, and until said frictional member starts to slide on said receiving part, the angle does not progressively decrease so as to assist storage of elastic energy in said elastic engaging unit, and after said frictional member starts to slide on said receiving part, the angle progressively decreases as the forward stroke of key depression proceeds.

13. A keyboard apparatus comprising:

a support member;

a plurality of pivots that are provided on said support member;

a plurality of keys that are each pivotally supported on said support member for pivotal movement about an associated one of said pivots;

a key return device that imparts a returning habit to each of said keys such that the key returns into a non-depressed state when the key is not depressed; and a key touch feeling-imparting mechanism that imparts a predetermined feeling characteristic to each of said keys when the key is depressed, wherein each of said keys has a key operating part, wherein said key touch feeling-imparting mechanism comprises an elastic engaging unit that has one end thereof held by said key operating part of an associated one of said keys and another end thereof holding a mass member, and a receiving part that is provided on said support member, wherein said receiving part slopes with respect to the key depression direction, wherein the other end of said elastic engaging unit is slidably engaged with said receiving part, wherein said elastic engaging unit comprises a member that is capable of storing elastic energy, and wherein said receiving part and said elastic engaging unit are disposed such that an angle formed between a line segment connecting between a contact point of said receiving part and the other end of said elastic engaging unit and the one end of said elastic engaging unit, and said receiving part progressively decreases as a forward stroke of key depression proceeds.

14. A keyboard apparatus as claimed in claim 13, wherein said receiving part and said elastic engaging unit are disposed such that the other end of said elastic engaging unit starts to slide on said receiving part during the forward stroke of key depression, and until the other end of said elastic engaging unit starts to slide on said receiving part, the angle does not progressively decrease so as to assist storage of elastic energy in said elastic engaging unit, and after the other end of said elastic engaging unit starts to slide on said receiving part, the angle progressively decreases as the forward stroke of key depression proceeds.

15. A keyboard apparatus comprising:

a support member;

a plurality of pivots that are provided on said support member;

a plurality of keys that are each pivotally supported on said support member for pivotal movement about an associated one of said pivots;

a key return device that imparts a returning habit to each of said keys such that the key returns into a non-depressed state when the key is not depressed; and a key touch feeling-imparting mechanism that imparts a predetermined feeling characteristic to each of said keys when the key is depressed, wherein each of said keys has a key operating part, wherein said key touch feeling-imparting mechanism comprises a receiving part that is provided on said support part, and an elastic engaging unit that has one end thereof held by said key operating part of an associated one of said keys and another end thereof in contact with said receiving part, wherein said elastic engaging unit comprises a member that is capable of storing elastic energy, wherein said elastic engaging unit is disposed to starts sliding on said receiving part during a forward stroke of key depression, and wherein said receiving part and said elastic engaging unit are disposed such that a contact angle formed between said receiving part and the other end of said elastic engaging unit progressively decreases as the forward stroke of key depression proceeds.

16. A keyboard apparatus as claimed in claim 15, wherein said elastic engaging unit comprises a spring member, wherein said spring member is disposed such that the contact angle progressively decreases as an amount of bend of said spring member in a predetermined direction progressively increases, and wherein said spring member is bent beforehand in the predetermined direction at a start of the forward stroke of key depression.

17. A keyboard apparatus comprising:

a support member;

a plurality of pivots that are provided on said support member;

a plurality of keys that are each pivotally supported on said support member for pivotal movement about an associated one of said pivots;

a key return device that imparts a returning habit to each of said keys such that the key returns into a non-depressed state when the key is not depressed; and a key touch feeling-imparting mechanism that imparts a predetermined feeling characteristic to each of said keys when the key is depressed, wherein each of said keys has a key operating part, wherein said key touch feeling-imparting mechanism comprises an elastic engaging unit that has one end thereof held by said key operating part of an associated one of said keys and another end thereof holding a mass member, and a receiving part that is provided on said support member, wherein the other end of said elastic engaging unit is slidably engaged with said receiving part, wherein said elastic engaging unit comprises a member that is capable of storing elastic energy, wherein said elastic engaging unit is disposed such that the other end thereof starts to slide on said receiving part during a forward stroke of key depression, and wherein said receiving part and said elastic engaging unit are disposed such that a contact angle formed between said receiving part and the other end of said elastic engaging unit progressively decreases as the forward stroke of key depression proceeds.

18. A keyboard apparatus as claimed in claim 17, wherein said elastic engaging unit comprises a spring member, wherein said spring member is disposed such that the contact angle progressively decreases as an amount of bend of said spring member in a predetermined direction progressively increases, and wherein said spring member is bent beforehand in the predetermined direction at a start of the forward stroke of key depression.

19. A keyboard apparatus comprising:

a support member;

a plurality of pivots that are provided on said support member;

a plurality of keys that are each pivotally supported on said support member for pivotal movement about an associated one of said pivots;

a key return device that imparts a returning habit to each of said keys such that the key returns into a non-depressed state when the key is not depressed; and a key touch feeling-imparting mechanism that imparts a predetermined feeling characteristic to each of said keys when the key is depressed, wherein each of said keys has a key operating part, wherein said key touch feeling-imparting mechanism comprises a engaging unit connected to said key operating part of an associated one of said keys, and a receiving part that is provided on said support member, wherein said receiving part slopes with respect to the key depression direction, wherein said engaging unit has one end thereof rotatably connected to said key operating part, and another end thereof slidably engaged with said receiving part and holding a mass member, and wherein said receiving part and said engaging unit are disposed such that an angle formed between a line segment connecting between a contact point of said receiving part and the other end of said engaging unit and the one end of said engaging unit, and said receiving part progressively decreases as a forward stroke of key depression proceeds.

20. A keyboard apparatus comprising:

a support member;

a plurality of pivots that are provided on said support member;

a plurality of keys that are each pivotally supported on said support member for pivotal movement about an associated one of said pivots;

a key return device that imparts a returning habit to each of said keys such that the key returns into a non-depressed state when the key is not depressed; and a key touch feeling-imparting mechanism that imparts a predetermined feeling characteristic to each of said keys when the key is depressed, wherein each of said keys has a key operating part, wherein said key touch feeling-imparting mechanism comprises an engaging unit connected to said key operating part of an associated one of said keys, and a receiving part that is provided on said support member, wherein said engaging unit has one end thereof rotatably connected to said key operating part, and another end thereof slidably engaged with said receiving part and holding a mass member, and wherein said receiving part and said engaging unit are disposed such that a contact angle formed between said receiving part and the other end of said engaging unit progressively decreases as the forward stroke of key depression proceeds.

21. A keyboard apparatus as claimed in one of claims 19 and 20, wherein said engaging unit comprises a plate spring member.

22. A keyboard apparatus as claimed in claim 21, wherein the other end of said plate spring member is bent such that said plate spring member is operable when the key is depressed, to bend in a predetermined direction.

* * * * *